US006674230B1

(12) United States Patent
Carpinelli et al.

(10) Patent No.: US 6,674,230 B1
(45) Date of Patent: Jan. 6, 2004

(54) ASYMMETRIC SPACE-SAVING CATHODE RAY TUBE WITH MAGNETICALLY DEFLECTED ELECTRON BEAM

(75) Inventors: Joseph Michael Carpinelli, Lawrenceville, NJ (US); Dennis John Bechis, Yardley, PA (US); George Herbert Needham Riddle, Princeton, NJ (US)

(73) Assignee: Sarnoff Corporation, Princeton, NJ (US)

( * ) Notice: Subject to any disclaimer, the term of this patent is extended or adjusted under 35 U.S.C. 154(b) by 369 days.

(21) Appl. No.: 09/615,848

(22) Filed: Jul. 13, 2000

Related U.S. Application Data

(63) Continuation-in-part of application No. 09/561,536, filed on Apr. 28, 2000, now Pat. No. 6,476,545.

(60) Provisional application No. 60/131,919, filed on Apr. 30, 1999, provisional application No. 60/137,379, filed on Jun. 3, 1999, provisional application No. 60/160,654, filed on Oct. 21, 1999, provisional application No. 60/160,772, filed on Oct. 21, 1999, and provisional application No. 60/170,159, filed on Dec. 10, 1999.

(51) Int. Cl.[7] ..... H01J 29/64; H01J 29/76

(52) U.S. Cl. ..... 313/433; 313/427; 313/422; 313/431

(58) Field of Search ..... 313/422, 423, 313/411, 412, 413, 421, 427, 430, 431, 433, 439, 440

(56) References Cited

U.S. PATENT DOCUMENTS

| | | | | |
|---|---|---|---|---|
| 2,459,732 A | * | 1/1949 | Bradley | 313/430 |
| 2,520,512 A | | 8/1950 | Samson | |
| 3,185,879 A | | 5/1965 | Evans, Jr. | |
| 3,461,333 A | * | 8/1969 | Havn | 313/422 |
| 3,524,197 A | | 8/1970 | Soule | |
| 3,873,877 A | * | 3/1975 | Machida | 313/430 |

(List continued on next page.)

FOREIGN PATENT DOCUMENTS

| | | |
|---|---|---|
| DE | 14 87 095 | 1/1969 |
| EP | 0 221 639 A | 5/1987 |

(List continued on next page.)

OTHER PUBLICATIONS

PCT Application, PCT/US00/27439, Written Opinion, Dated Apr. 1, 2002, 4 pages.

(List continued on next page.)

*Primary Examiner*—Nimeshkumar D. Patel
*Assistant Examiner*—Karabi Guharay
(74) *Attorney, Agent, or Firm*—William J. Burke

(57) ABSTRACT

A cathode ray tube includes an electron gun directing electrons away from a faceplate having an electrode biased at screen potential. One or more electromagnets located on or near the rear wall of the tube envelope are biased with dc currents so that the electron beam (three beams in a color tube) is deflected by the magnetic field produced thereby to impinge upon the faceplate. The electron beam is magnetically deflected over a relatively small angle as it exits the electron gun to scan across the faceplate to impinge upon phosphors thereon to produce light depicting an image or information. The electromagnet closest the electron gun is typically biased to produce a strong magnetic field to deflect electrons to the faceplate near to the electron gun. The electromagnets more distant the electron gun produce magnetic fields to direct electrons towards the faceplate, with the electromagnet most distant the electron gun deflecting the electrons to tend to increase the landing angle thereof on the faceplate. One or more of the foregoing electromagnets may be utilized in cooperation with one or more electrodes biased at a potential to similarly deflect the electrons to the faceplate.

32 Claims, 7 Drawing Sheets

U.S. PATENT DOCUMENTS

| | | | | | |
|---|---|---|---|---|---|
| 3,899,710 | A | * | 8/1975 | Machida et al. | 313/412 |
| 4,180,760 | A | | 12/1979 | Chang | |
| 4,323,816 | A | | 4/1982 | Chang | |
| 4,329,618 | A | | 5/1982 | Chang | |
| 4,374,343 | A | | 2/1983 | Chang | |
| 5,023,509 | A | * | 6/1991 | Deal et al. | 313/412 |
| 5,038,074 | A | * | 8/1991 | Nakamura | 313/429 |
| 5,327,044 | A | | 7/1994 | Chen | |
| 5,357,176 | A | * | 10/1994 | Nishio et al. | 313/439 |
| 6,603,252 | B1 | * | 8/2003 | Carpinelli et al. | 313/421 |

FOREIGN PATENT DOCUMENTS

| | | | |
|---|---|---|---|
| EP | 0 334 438 | | 9/1989 |
| EP | 0 418 962 | | 3/1991 |
| FR | 1 052 647 | A | 1/1954 |
| GB | 469 420 | A | 7/1937 |
| GB | 469 455 | A | 7/1937 |
| GB | 547 529 | A | 9/1942 |
| GB | 663 041 | A | 12/1951 |
| GB | 822 911 | A | 11/1959 |
| GB | 865667 | | 4/1961 |
| GB | 903587 | | 8/1962 |
| GB | 2059144 | | 4/1981 |
| GB | 2 114 806 | A | 8/1983 |
| JP | 60200444 | | 10/1985 |
| WO | WO 86/06211 | | 10/1986 |

OTHER PUBLICATIONS

International Search Report, PCT/US00/27439, Jan. 19, 2001 (3 Pages).

* cited by examiner

ASYMMETRIC SPACE-SAVING CATHODE RAY TUBE WITH MAGNETICALLY DEFLECTED ELECTRON BEAM

This Application is a continuation-in-part of U.S. patent application Ser. No. 09/561,536 filed Apr. 28, 2000, now U.S. Pat. No. 6,476,545 which claims the benefit of: U.S. Provisional Application Serial No. 60/131,919 filed Apr. 30, 1999, U.S. Provisional Application Serial No. 60/137,379 filed Jun. 3, 1999, U.S. Provisional Application Serial No. 60/160,654 filed Oct. 21, 1999, U.S. Provisional Application Serial No. 60/160,772 filed Oct. 21, 1999, and U.S. Provisional Application Serial No. 60/170,159 filed Dec. 10, 1999.

The present invention relates to a cathode ray tube and, in particular, to a cathode ray tube including a deflection aiding magnetic field.

Conventional cathode ray tubes (CRTs) are widely utilized, for example, in television and computer displays. One or more electron guns positioned in a neck of a funnel-shaped glass bulb of a CRT direct a corresponding number of beams of electrons toward a glass faceplate biased at a high positive potential, e.g., 30 kilovolts (kV). The faceplate usually has a substantially rectangular shape and is generally planar or slightly curved. Together, the glass bulb and faceplate form a sealed enclosure that is evacuated. The electron gun(s) are positioned along an axis that extends through the center of the faceplate and is perpendicular thereto.

The electron beam(s) is (are) raster scanned across the faceplate so as to impinge upon a coating or pattern of phosphors on the faceplate that produces light responsive to the intensity of the electron beam, thereby to produce an image thereon. The raster scan is obtained by a deflection yoke including a plurality of electrical coils positioned on the exterior of the funnel-shaped CRT near the neck thereof. Electrical currents driven in first coils of the deflection yoke produce magnetic fields that cause the electron beam(s) to deflect or scan from side to side (i.e. horizontal scan) and currents driven in second coils of the deflection yoke produce magnetic fields that cause the electron beam(s) to scan from top to bottom (i.e. vertical scan). The magnetic deflection forces typically act on the electrons of the beam(s) only within the first few centimeters, e.g., 5–10 cm, of their travel immediately after exiting the electron gun(s), and the electrons travel in a straight line trajectory thereafter, i.e through a substantially field-free drift region. Conventionally, the horizontal scan produces hundreds of horizontal lines in the time of each vertical scan to produce the raster-scanned image.

The depth of a conventional CRT, i.e. the distance between the faceplate and the rear of the neck, is determined by the maximum angle over which the deflection yoke can bend or deflect the electron beam(s) and the length of the neck extending rearward to contain the electron gun. Greater deflection angles provide reduced CRT depth.

Modem magnetically-deflected CRTs typically obtain a ±55° deflection angle, which is referred to as 110° deflection. However, such 110° CRTs for screen diagonal sizes of about 62 cm (about 25 inches) or more are so deep that they are almost always provided in a cabinet that either requires a special stand or must be placed on a floor. For example, a 110° CRT having a faceplate with an about 100 cm (about 40 inch) diagonal measurement and a 16:9 aspect ratio, is about 60–65 cm (about 24–26 inches) deep. Practical considerations of increasing power dissipation producing greater temperature rise in the magnetic deflection yoke and its drive circuits and of the higher cost of a larger, heavier, higher-power yoke and drive circuitry prevent increasing the maximum deflection angle as is necessary to decrease the depth of the CRT.

A further problem in increasing the deflection angle of conventional CRTs is that the landing angle of the electron beam on the shadow mask decreases as deflection angle is increased. Because the shadow mask is as thin as is technically reasonable at an affordable cost, the thickness of the present shadow mask results in an unacceptably high proportion of the electrons in the electron beam hitting the side walls of the apertures in the shadow mask for low landing angles. This produces an unacceptable reduction of beam current impinging on the phosphor and a like decrease in picture brightness for low landing angles, e.g., landing angles less than about 25°.

Even if one were to increase the deflection angle to ±90° (180° deflection) and solve the low landing angle problem, the length of the tube neck remains a limiting factor in reducing overall tube depth.

One approach to this depth dilemma has been to seek a thin or so-called "flat-panel" display that avoids the large depth required by conventional CRTs. Flat panel displays, while desirable in that they would be thin enough to be hung on a wall, require very different technologies from conventional CRTs which are manufactured in very high volume at reasonable cost. Thus, flat panel displays are not available that offer the benefits of a CRT at a comparable cost. But a reduced-depth cathode ray tube as compared to a CRT need not be so thin that it could be hung on a wall to overcome the disadvantage of the great depth of a conventional CRT.

Accordingly, there is a need for a cathode ray tube having a depth that is less than that of a conventional CRT having an equivalent screen-size, and reducing the added depth owing to the length of the tube neck.

To this end, the tube of the present invention comprises a tube envelope having a faceplate and a screen electrode on the faceplate adapted to be biased at a screen potential, and a source of at least one beam of electrons directed away from the faceplate, wherein the source is adapted for scanning deflection of the at least one beam of electrons. Phosphorescent material disposed on the faceplate for producing light in response to the at least one beam of electrons impinging thereon. At least a first magnetic source is disposed proximate the tube envelope to produce a magnetic field therein for tending to bend the at least one beam of electrons in a direction towards said faceplate.

According to an aspect of the invention, a cathode ray tube comprises a tube envelope having a generally flat faceplate and a screen electrode on the faceplate adapted to be biased at a screen potential, and having a tube neck adjacent the faceplate. In the tube neck, a source directs at least one beam of electrons away from the faceplate, wherein the source is adapted for scanning deflection of the at least one beam of electrons. A deflection yoke around the tube neck deflects the at least one beam of electrons over a predetermined range of deflection angles. Phosphorescent material disposed on the faceplate produces light in response to the at least one beam of electrons impinging thereon. At least one magnetic source is mounted on an exterior surface of the tube envelope intermediate the source of at least one beam of electrons and the faceplate, wherein the magnetic source produces a magnetic field for deflecting the at least one beam of electrons in a direction towards said faceplate. At least one static deflection element is mounted on the tube envelope one of nearer to and farther from the faceplate than the magnetic source, the static deflection element being biased for deflecting the at least one beam of electrons towards the faceplate.

According to another aspect of the invention, a display comprises a tube envelope having a faceplate and a screen electrode on the faceplate biased at a screen potential and a source within the tube envelope of at least one beam of electrons directed away from said faceplate. A deflection yoke proximate the source of at least one beam of electrons magnetically deflects the at least one beam of electrons and a phosphorescent material disposed on the faceplate for producing light in response to the at least one beam of electrons impinging thereon. At least a first electromagnet is disposed proximate the tube envelope intermediate the source of at least one beam of electrons and the faceplate, wherein the at least first electromagnet is poled for tending to bend the at least one beam of electrons in a direction towards the faceplate. A source provides direct current bias for the at least first electromagnet and bias potential for the screen electrode.

BRIEF DESCRIPTION OF THE DRAWING

The detailed description of the preferred embodiments of the present invention will be more easily and better understood when read in conjunction with the FIGURES of the Drawing which include.

Figure 1:
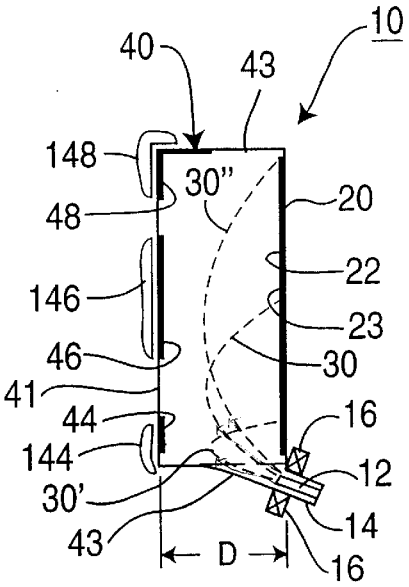
FIG. 1 is a side view cross-sectional schematic diagram of an exemplary embodiment of a cathode ray tube in accordance with the present invention.

In the Drawing, where an element or feature is shown in more than one drawing figure, the same alphanumeric designation may be used to designate such element or feature in each figure, and where a closely related or modified element is shown in a figure, the same alphanumerical designation primed may be used to designate the modified element or feature. Similarly, similar elements or features may be designated by like alphanumeric designations in different figures of the Drawing and with similar nomenclature in the specification, but in the Drawing are preceded by digits unique to the embodiment described. For example, a particular element may be designated as "xx" in one figure, by "1xx" in another figure, by "2xx" in another figure, and so on.

DESCRIPTION OF THE PREFERRED EMBODIMENTS

In a cathode ray tube according to the present invention, the electron gun is positioned at or near the screen or viewing end of the tube enclosure and directs electrons of a deflected electron beam away from the screen or faceplate. The electrons are further deflected after leaving the influence of the deflection yoke to return to the screen, i.e. the electrons travel in curved, substantially parabola-like trajectories from the electron gun to landing on the faceplate. In a conventional CRT, the electrons are directed directly at the screen and are at the screen or anode potential at the time they leave the gun and deflection regions and, not being under the influence of any electric or magnetic field, travel in straight lines to the screen or faceplate thereof. As used herein, a cathode ray tube according to the present invention may be utilized, for example, as a display tube, computer display tube, color picture tube, monitor, projection tube, and the like.

FIG. 1 is a cross-sectional diagram of a cathode ray tube 10 according to the present invention in its simplest form. It is noted that unless otherwise specified, such cross-sectional diagrams may be considered to illustrate the vertical deflection orientation unless otherwise noted.

In exemplary cathode ray tube 10 of FIG. 1, electrons produced by electron gun 12 located in tube neck 14 are directed away from faceplate 20 which includes a screen or anode electrode 22 which is biased at a relatively high positive potential. Electron beam 30 is subsequently deflected so as to change direction and become directed towards faceplate 20. The electrons forming electron beam 30 produced by electron gun 12 are initially deflected by magnetic fields produced by deflection yoke 16 to scan across a deflection angle sufficient to scan the landing point of electron beam 30 when subsequently deflected towards faceplate 20 across the width and height dimensions of faceplate 20, as described herein.

Tube 10 is illustrated in FIG. 1 in a somewhat generalized way as a rectangular enclosure 40 with two parallel flat plates 20', 41' separated by a distance "D" representing the distance between flat backplate 41 and flat faceplate 20, e.g., the length of side wall 43. Under the influence of the high positive bias potential of screen electrode 22 on faceplate 20, the electrons of deflected electron beam 30, 30', 30" (one beam illustrated in three different representative deflected positions) travel in curved, substantially parabola-like trajectories to land on screen 22. The forward end of glass bulb 40 is sealed to glass faceplate 20 to form a container that can be evacuated. Note that while the electron beam is scanned over a range of angles producing trajectories 30', 30, 30" having landing positions on faceplate 20 that are proximate, intermediate and distal, respectively, of electron gun 12, the electron beam in the various trajectory positions may be referred to and identified herein as electron beams 30', 30, 30", respectively.

Figure 2:
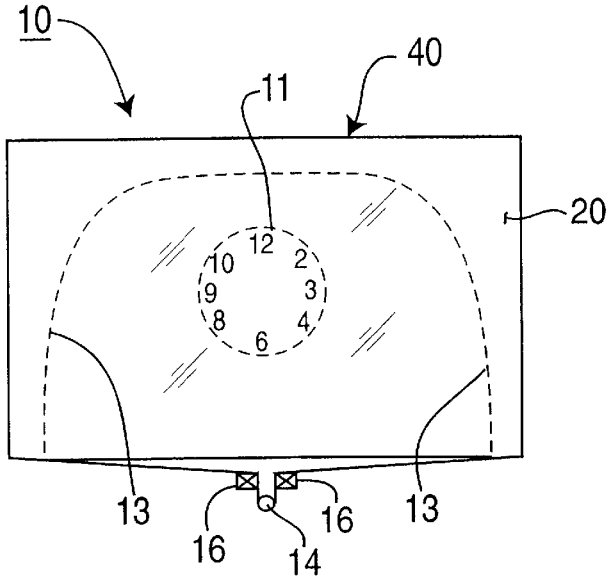
FIG. 2 is a front view schematic diagram of an exemplary embodiment of a cathode ray tube in accordance with the present invention, such as the cathode ray tube of FIG. 1.

FIG. 2 illustrates a front view of an exemplary cathode ray tube according to the invention, for example a tube 10 as in FIG. 1. Faceplate 20 thereof is generally rectangular, for example in a 16:9 aspect ratio as for displaying high-definition television images or in a 4:3 aspect ratio as for displaying standard definition television images. Clock face 11, shown in phantom, is to illustrate positions on the faceplate 20 of tube 10. For example, faceplate 20 has an upper edge in the 12 o'clock position, a lower edge in the 6 o'clock position, and left and right edges in the 9 o'clock and 3 o'clock positions, respectively. Upper left- and right-hand corners of faceplate 20 are at the 10 o'clock and 2 o'clock positions and the lower left and right corners are at the 8 o'clock and 4 o'clock positions, respectively. Tube neck 14 is in the 6 o'clock position slightly below the lower edge of faceplate 20 and is surrounded by deflection yoke 16.

The curved trajectories of electron beam 30 of FIG. 1 may be analogized to the idealized parabola-like trajectory of an object launched skyward under the force of gravity, but not affected by atmosphere (e.g., in a vacuum). The height the object reaches vertically before it is returned towards earth by gravity is a function of the vertical component of the velocity at which it is launched and the distance it travels horizontally is a function of both the horizontal and vertical components of that launch velocity. With a fixed launch velocity magnitude, the horizontal distance may be varied by changing the launch angle. With a high launch angle, e.g., approaching 90° or vertical, the object travels little or no horizontal distance because the horizontal component of the launch velocity is substantially zero, although it does travel a long distance up and down vertically. Maximum horizontal distance obtains when the object is launched at a 45° angle. Thus, by varying the launch angle between 90° and 45° the object can be caused to land at any horizontal distance between zero and the maximum horizontal distance from the launch point.

For cathode ray tube 10, electron gun 12 is positioned at an angle about 22½° from perpendicular to faceplate 20 and the launch angle of electron beam 30 is scanned over an about ±22½° angle by deflection yoke 16, thereby to launch electron beam 30 over a range of angles between 45° and 90° with respect to faceplate 20. As a result, since the electric fields produced by electrodes 44, 46, 48 and 22 and/or the magnetic fields produced by electromagnets 144, 146, 148 act on the electrons of beam 30 in similar manner to that in which gravity acts on the object in the preceding paragraph, electron beam 30 is scanned between the edge of faceplate 20 close to electron gun 12 to the opposite edge distal therefrom, i.e. between the edge at the 6 o'clock position to the edge at the 12 o'clock position.

Because the magnetic field produced by deflection yoke 16 deflects electron beam 30 over a total deflection angle of 45° which is much smaller than that required in a conventional CRT, e.g., 110°, yoke 16 is a smaller, lighter, lower power yoke than that necessary for a conventional CRT of similar screen size.

Backplate 41 includes a number of electrodes 44, 46, 48 that are biased to different potentials, including relatively high positive potentials, but preferably less than the high positive potential of screen electrode 22. The ultor of gun 12 is also biased, for example, to the screen potential or other "free-space" potential at the exit of the electron gun, for controlling electron-injection effects. Under the influence of the forces produced by the bias potentials of electrodes 44, 46, 48, and/or the magnetic fields of electromagnets 144, 146, 148, and the high positive potential bias of screen electrode 22, the electrons of electron beam 30, 30', 30" follow shaped, curved trajectories from electron gun 12 to land on faceplate 20. These bias potentials and magnetic fields are graduated to have different influence on the electrons of electron beam 30, 30', 30" depending upon the distance along faceplate 20 from electron gun 12. Electrode 48 and electromagnet 148 may reside on backplate 41 or on side wall 43 of tube envelope 40, or may reside on both of back wall 41 and side wall 43.

It is noted that where tube 10 includes electromagnet 144, electrode 44 could be eliminated or biased to a suitable potential, where it includes electromagnet 146, electrode 46 could be eliminated or biased to screen potential, and where it includes electromagnet 148, electrode 48 could be eliminated or biased to screen potential. Thus tube 10 may include one or two or all of electromagnets 144, 146, 148, but where it includes only one or two of those electromagnets 144, 146, 148, then it may optionally include biasing only the one or ones of electrodes 44, 46, 48 positioned under the one or ones of electromagnets 144, 146, 148 that is/are not present for further deflecting the electron beam. Thus, tube 10 includes one or more electromagnets 144, 146, 148 or the equivalent thereof, and may optionally include in addition one or two of electrodes 44, 46, 48 or its equivalent. Ones of electrodes 44, 46, 48 not biased for deflection may be connected together and/or suitably biased, e.g., to provide a electric field-free drift region for the electrons of electron beams 30.

In the region influenced by the field produced by electromagnet 144 or alternatively by the potential of electrode 44, for example, a relatively strong force directs the electrons of beam 30' towards faceplate 20. In the region influenced by the field produced by electromagnet 146 or alternatively by the potential of electrode 46, for example, a relatively less strong force directs the electrons of beam 30 towards faceplate 20, thereby allowing the electrons to travel towards the edges and corners of face plate 20. In the region influenced by the field produced by electromagnet 148 or alternatively by the potential of electrode 48, for example, a relatively weaker yet force may direct the electrons of beam 30" towards faceplate 20, thereby in conjunction with electrode 46 allowing the electrons to travel to the edges and corners of faceplate 20. Alternatively, the field produced by electromagnet 148 or by the potential of electrode 48 may produce a relatively weak force in the direction away from faceplate 20, thereby increasing the distance the electrons of beam 30" travel towards the edges and corners of faceplate 20, but decreasing the electron landing angle on faceplate 20.

For example, screen electrode 22 is typically biased at a potential of about +30 kV. If electromagnet 144 is not utilized, electrode 44 is typically biased to a negative potential, e.g., −15 kV, so as to reduce the distance that electrons of electron beam 30 when deflected to trajectory 30' travel away from electron gun 12 in a direction perpendicular to faceplate 20. If electromagnet 146 is not utilized, electrode 46 is typically biased to an intermediate positive potential, e.g., +5 kV to +15 kV, so as to increase the distance that electrons of electron beam 30 when deflected to trajectory 30 and 30" travel away from electron gun 12 along faceplate 20, i.e. in a direction parallel thereto. If electromagnet 148 is not utilized, electrode 48 is typically biased to a higher positive potential so as to either further increase the distance that electrons of electron beam 30 when deflected to trajectory 30" travel away from electron gun 12 along faceplate 20 or to increase the ir landing angle on faceplate 20. E.g., a bias potential of +25 kV to +30 kV could increase landing angle and a bias of +30 kV to +35 kV could increase deflection.

In any event, it is noted that more precise control over the shape of the electron-trajectory force gradient profile may be had by increasing the number of electromagnets and tailoring the values and/or the polarity of bias currents applied thereto (or where electrodes are utilized, by increasing the number of electrodes and tailoring the bias potentials applied thereto).

Absent the cooperative effects of the magnetic fields produced by the bias currents applied to electromagnets 144, 146, 148, the electrons of beam 30 would not reach all the way to the 3 o'clock, 9 o'clock and 12 o'clock edges of faceplate 20, but would undesirably fall short, such as only reaching as far as phantom line 13 of FIG. 2, for example. The directing of electrons of electron beam 30" towards faceplate 20 in the region further from electron gun 12 than phantom line 13 is enhanced where the bias current applied to electromagnet 148 on side wall 43 is to bend the electrons towards screen 22.

In addition, the bias field of electromagnet 148 on side wall 43 may be graduated to tailor the magnetic field produced thereby to enhance this effect. For example, the field-producing bias current may be graduated by employing plural electromagnets that comprise electromagnet 148 biased differently to establish different magnetic field strengths along the region from back wall 41 to faceplate 20 to increase the distance electrons travel along faceplate 20 away from electron gun 12 and to increase landing angle. In practice, such graduated field as may be obtained from plural electromagnets may be provided by appropriate distribution of plural coil windings on a magnetic core having a specific geometry.

Conceptually, one may loosely analogize this graduated magnetic field to the example in classical gravitational physics of an object that is projected at a launch angle in a vacuum, such as a baseball hit by a batter on the fly towards the outfield (in the theoretical stadium without atmosphere to remove the effects thereof on trajectory). Classically, a baseball so hit travels along a parabolic trajectory under the influence of a uniform gravitational field to land in the outfield, typically to be caught by an outfielder. So would electrons launched from electron gun 12 travel to land somewhere in a middle region of faceplate 20 under the influence of a uniform field produced by the screen potential. If, however the gravitational field were to be non-uniform so that the force of gravity were to miraculously decrease beyond second base, then the trajectory of the baseball would be extended and, instead of being caught by the outfielder, the baseball would travel a much greater distance, thereby to become a home run. Similarly, in the tube of the invention, the magnetic fields produced by electromagnets 144, 146, 148 cooperate to control the force acting on the electrons of electron beam 30 allowing them to reach the far edges of faceplate 20.

Figure 3:
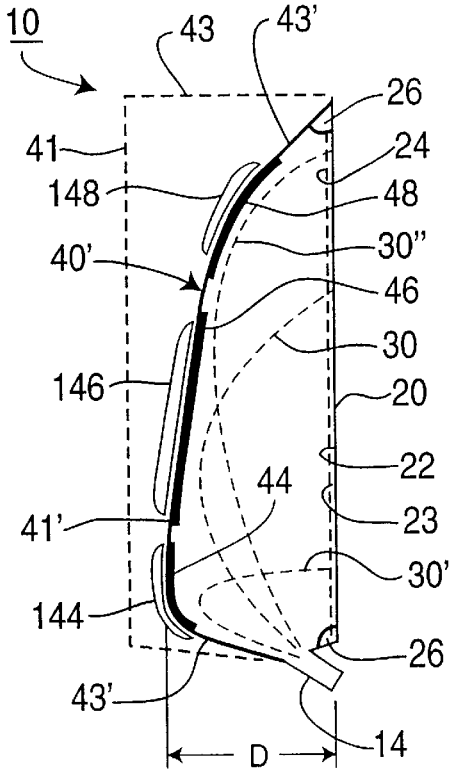
FIGS. 3 and 4 are side view cross-sectional schematic diagrams of exemplary modified cathode ray tubes similar to the tube of FIG. 1 illustrating an exemplary shaped tube enclosure in accordance with the present invention.

Thus, control of the bias currents applied to electromagnets positioned on the backplate and side wall of the tube creates a particular magnetic field that is employed in accordance with the invention to control the trajectories of the electrons of the electron beam 30. As a result, the distance required between the faceplate 20 and backplate 41 of an exemplary tube 10 in accordance with the invention to be substantially less than that of a conventional tube of like screen size. As shown in FIG. 3, the shape of back wall 41 and of side wall 43 of tube enclosure 40 may be shaped or arcuate walls 41', 43' so as to generally conform to the shape of the locus of the apex or peaks of the trajectories, e.g., trajectories 30, 30', 30" of the electrons of electron beam 30. Walls 41', 43' are shaped to be spaced apart slightly, e.g., 0.5–2 cm, from the peaks of the electron trajectories.

A coating of phosphorescent material 23 is disposed on faceplate 20 for producing light in response to the beam of electrons 30 impinging thereon, thereby providing a monochromatic display, or a pattern of different phosphorescent materials 23 is disposed thereon for producing different colors of light in response to the beam of electrons 30 impinging thereon through apertures in a shadow mask (not shown in FIG. 1), thereby providing a color display.

Tube 10 of FIG. 3 includes a gun 12 in neck 14 generally centrally located below the center of the lower edge of backplate 40 to direct a beam of electrons 30 generally away from faceplate 20 which includes a screen electrode 22 biased at a relatively high positive potential. Faceplate 20 and backplate 40 are of similar size and are joined annularly at their peripheries to form a sealed container that can be evacuated. Deflection yoke 16 (not shown, but similar to FIGS. 1 and 4) surrounds neck 14 in the region of its juncture with backplate 40 for magnetically deflecting electrons generated by gun 12 as they proceed out of gun 12, subsequently deflected toward faceplate 20 to impinge upon the phosphor(s) 23 thereon.

Advantageously, electromagnet 148 is located distal electron gun 12 of tube 10 and on shaped wall 43' near the periphery of faceplate 20 where the landing angle of beam 30 is smallest. With electromagnet 148 biased to produce a field that tends to direct the electrons of beam 30" back towards faceplate 20, the landing angle of electron beam 30" near the periphery of faceplate 20 is increased. Thus, the magnetic fields created by electromagnets 146 and 148 complement each other in that electromagnet 146 which increases the throw distance may also decrease the landing angle at the periphery of faceplate 20, and electromagnet 148 which has its strongest effect near the periphery of faceplate 20 may act to increase the landing angle in the region where it might otherwise be undesirably small.

The shape of the glass tube envelope 40' is advantageous in that it requires less glass than would a rectangular tube envelope and has more strength to resist implosion, thereby resulting in a lighter and safer cathode ray tube, not to mention a more aesthetically pleasing shape. It is noted that electromagnets 144, 146, 148 are spaced apart on or proximate to the exterior surface of tube envelope 40 in a substantially radial direction from electron gun 12, i.e. in the direction of the travel of the electrons produced thereby, and are positioned substantially transverse to the direction of electron travel. Electromagnets 144, 146, 148 are preferably conformed to the shape of tube envelope and may be mounted thereon, such as by bonding, similarly to the bonding of a deflection yoke to a CRT.

The relationship and effects of the magnetic fields described above cooperate in a tube 10 that is substantially shorter in depth than a conventional 110° CRT of like screen size and yet operates at a lower deflection yoke power level. Tube 10 may be either a monochrome tube or a color tube, i.e. one producing a monochrome or a color image, respectively. Where tube 10 is a color tube, electron gun 12 produces plural electron beams corresponding to the plural colors of phosphor material 23 patterned on faceplate 20, e.g., in an in-line or triangular (delta) arrangement, as is conventional. A color tube 10 includes a shadow mask 24 having a pattern of apertures therethrough, which pattern corresponds to the pattern of color phosphors 23 on faceplate 20 for passing the appropriate one of the three electron beams to impinge on the corresponding color phosphor 23 to produce light to reproduce an image or information on faceplate 20 that is visible to a viewer looking thereat, as is conventional. Any of the tubes described herein may be either a monochrome tube or may be a color tube, and color tubes may employ a shadow mask, aperture grill, focus mask, tension mask, or other color-enabling structure proximate faceplate 20.

Shadow mask 24 is spaced slightly apart from and attached to faceplate 20 near their respective peripheries by shadow mask mounting frame 26. Conductive coating 22 on the inner surface of faceplate 20 is electrically coupled to shadow mask 24 at shadow mask mounting frame 26 and receives bias potential via high-voltage feedthrough conductor (not shown) penetrating the glass wall of bulb 40'. Shadow mask frame 26 is shaped, such as by having one or more conductive projections, to provide an electrostatic shield for any uncoated glass support beads therefor to avoid charging of such uncoated glass beads. Alternatively, a separate shield can be attached to mask frame 26 to shield any uncoated glass beads.

Optional alternative electrodes 44, 46, 48 are shown in FIG. 3 for reference, but may not be present in tube 10 and biased to exert electrostatic deflection forces upon the electrons of electron beam 30 unless the corresponding electromagnet 144, 146, 148, respectively, proximate thereto is eliminated. In the case where a biased electrode replaces an electromagnet, the deflection function of the magnetic field produced by the electromagnet for deflecting electrons may be performed by the electric field produced by such electrode. In the case where a particular electromagnet is utilized, the electrode proximate thereto may be retained and biased to screen potential so as to create an essentially electric-field-free space within tube envelope 40.

It is noted that the interior surface of tube envelope 40 may be coated with a conductive material that is biased at a high positive potential, such as the screen 22 potential, so that the electrons of electron beam 30 are in a region free of electrostatic fields after they leave the influence of deflection yoke 16. Further, electrode 44, conveniently also a conductive coating, may be located close to the exit of electrons from electron gun 12 and be biased at an intermediate potential, e.g., between 10 kV and 20 kV where the screen 22 is biased at about 30 kV, so as to slightly slow the electrons of electron beam 30 thereby tending to increase the time the electrons are subject to the deflection forces produced by deflection yoke 16, whereby the deflection produced by yoke 16 at a given level of yoke drive current is increased.

It is noted that as a result of the unique geometry and gradient magnetic field arrangement of a cathode ray tube according to the invention, the incidence of back-scattered electrons striking the phosphor material on faceplate 20 should be lower than that in a conventional CRT. Back-scattering of electrons arises because electrons strike internal tube structures, such as the shadow mask, and are scattered therefrom at sufficient energy levels to be again back-scattered from the rear of the tube and then return to impinge upon the phosphor on the tube faceplate. Back-scattering is controlled in conventional tubes by conductive coatings having a low Z number. Such coatings reside on the interior surface of the tube envelope and are biased at screen potential. In a tube according to the invention, electron back-scattering may similarly be controlled by low-Z coating materials on the rear wall and tube electrodes, or near the electron gun and yoke, for example, conductive coatings, such as aluminum, aluminum oxide, and graphite and other carbon-based coatings.

Figure 4:
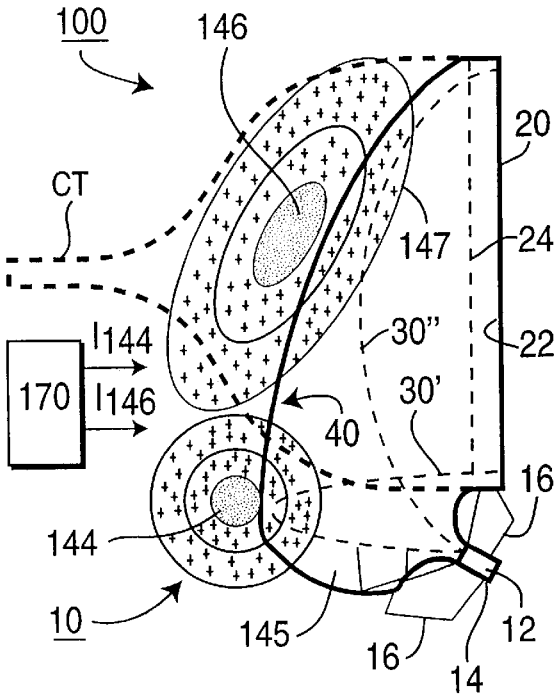

FIG. 4 is a side cross-sectional schematic diagram of a tube 10 employing magnetic deflection in accordance with the invention. Tube 10 includes a tube envelope 40 to which a faceplate 20 is attached to form a vacuum envelope containing shadow mask 24 and having a neck 14 containing electron gun 12 producing electron beam 30 that is deflected over a range of trajectories 30', 30" by deflection yoke 16, as above. To illustrate the space saving due to reduced tube depth (i.e. faceplate to rear-most part dimension) provided by tube 10 according to the invention, an outline of a conventional color tube envelope CT is shown in phantom in FIG. 4.

In the exemplary embodiment of FIG. 4, cathode ray tube 110 includes a first electromagnet 144 positioned proximate tube envelope 40 in a location intermediate or between that of deflection yoke 16 and that of faceplate 20 to produce magnetic fields within tube envelope 40 illustrated by field contours 145. In other words, electromagnet 144 produces a magnetic field that acts upon the electron beam 30 after it is acted upon by deflection yoke 16 and before it reaches faceplate 20. A second electromagnet 146 is positioned proximate tube envelope 40 in a location intermediate or between that of first electromagnet 144 and that of faceplate 20 to produce magnetic fields within tube envelope 40 illustrated by field contours 147. In other words, electromagnet 146 produces a magnetic field that acts upon the electron beam 30 after it is acted upon by electromagnet 144 and before it reaches faceplate 20. Field lines within field contours 145, 147 are shown by a pattern of "+" symbols to indicate field lines directed into the paper.

The field produced by electromagnet 144 is poled so that the electrons of electron beam 30 that pass within its influence are deflected toward faceplate 20. The field produced by electromagnet 146 is poled in like sense to the field of deflection electromagnet 146 so that the electrons of electron beam 30 that pass within its field are directed back toward faceplate 20, i.e. electromagnets 144, 146 act cooperatively to bend or deflect the electrons of beam 30 affected thereby to land on or impinge upon faceplate 20, as described above.

Current source 170 provides substantially fixed currents $I_{144}$ and $I_{146}$ that are applied to electromagnets 144 and 146, respectively, to establish the magnetic fields provided thereby. Generally, in view of the related nature of the magnetic fields produced by each of the electromagnets 144, 146 (and by electromagnet 148, if any), electromagnets 144, 146, and/or 148, may beneficially be connected in series to be biased by the same bias current. In addition, where any of electromagnets 144, 146, 148 is formed of a plurality of electromagnets (be it a pair of electromagnets or a set of a greater number of electromagnets), it may be desirable to apply the same bias current to all the coils of the electromagnets of a particular pair or set of one of electromagnets 144, 146, 148, but to separately generate the currents that are applied to the others of electromagnets 144, 146, 148. Alternatively, where the same current is utilized to drive plural coils; it may be desirable to provide means for separately adjusting the current levels in each coil, such as by a parallel resistance or other shunting path.

While the description herein refers to electromagnets, it is understood that permanent magnets, shaped and magnetized to produce the equivalent magnetic field, may replace the described electromagnets within the scope of the present invention.

Figure 5:
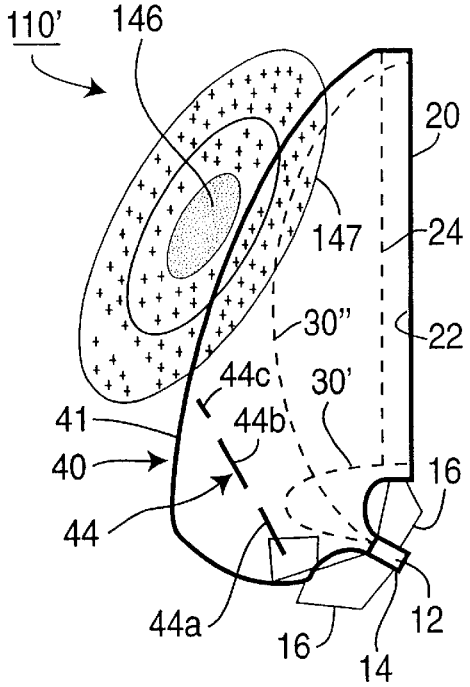
FIGS. 5 and 6 are side view cross-sectional schematic diagrams of alternative embodiments of a tube employing exemplary magnetic deflection arrangements in accordance with the invention.

In the exemplary alternative embodiment of FIG. 5, cathode ray tube 110' includes a first electromagnet 146 proximate tube envelope 40 and positioned along backplate 41 towards the far (upper) edge of faceplate 20 to produce magnetic fields within tube envelope 40 illustrated by field contours 147. An electrode 44 on or proximate tube envelope 40 intermediate the tube neck 14—deflection yoke 16 region and first electromagnet 146 is biased at a negative potential to produce an electrostatic field within tube envelope 40. The electrostatic field produced by electrode 44 tends to bend the electrons of electron beam 30 that pass within its influence towards faceplate 20 so that those electrons are deflected toward faceplate 20 to land thereon. The field produced by electromagnet 146 is poled to tend to bend the electrons of electron beam 30 in cooperation with the field of deflection electrode 44, so that the electrons of electron beam 30 that pass within their respective fields are directed back toward faceplate 20, i.e. electromagnet 146 acts to bend electron beam 30 towards faceplate 20 to land thereon at a suitable landing angle, as described above.

In FIG. 5, electrode 44 is illustrated as three sub-electrodes 44*a*, 44*b*, 44*c* that may be biased at different potentials for more precisely shaping the electric field produced thereby. In similar fashion, electromagnet 146 may comprise plural electromagnets placed side by side and biased to produce different field magnitudes to more precisely shape the magnetic field contours 147 for bending electron beam 30. Alternatively, a substantially equivalent magnetic field may be provided by a plurality of electrical coils distributed on one or more shaped magnetic core of ferrite or other suitable magnetic material. In addition, a conductive coating is typically deposited on the interior of tube funnel 41 in the region of electromagnet 146 and is biased to the same potential as is screen 22 or to another suitable potential.

Figure 6:
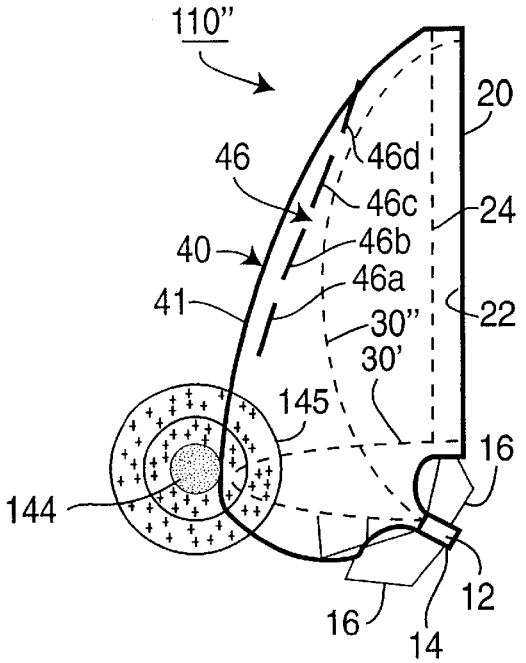

In the exemplary alternative embodiment shown in FIG. 6, cathode ray tube 110" includes a first electromagnet 144 proximate tube envelope 40 in the region proximate deflection yoke 16 and faceplate 20 to produce a magnetic field within tube envelope 40 illustrated by field contours 145, similarly to FIG. 5 above. An electrode 46 on or proximate tube envelope 40 and positioned along back plate 41 intermediate first electromagnet 144 and the far (upper) edge of faceplate 20 is biased at a potential less than screen potential to produce an electrostatic field within tube envelope 40. The field produced by electromagnet 144 is poled so that the electrons of electron beam 30 that pass within its influence are relatively strongly deflected toward faceplate 20 to bend electron beam 30 to land on faceplate 20. The field produced by electrode 46 also tends to bend electron beam 30 towards faceplate 20, but less strongly than does electromagnet 144 so that the electrons of electron beam 30 that pass within its field are directed back toward faceplate 20 to land thereon with a suitable landing angle, as described above.

In FIG. 6, electrode 46 is illustrated as three sub-electrodes 46*a*, 46*b*, 46*c*, 46*d* that may be biased at different potentials for more precisely shaping the electric field produced thereby. In similar fashion, electromagnet 144 may comprise plural electromagnets placed side by side and biased to produce different field magnitudes to more precisely shape the magnetic field contours 145 for bending electron beam 30. Alternatively, a substantially equivalent magnetic field may be provided by a plurality of electrical coils distributed on one or more shaped magnetic core of ferrite or other suitable magnetic material.

It is anticipated that the depth of tube 10, 110, 110', 110" in accordance with the invention can be reduced in depth by about a factor of two or more as compared to a conventional 110° CRT with a rearward projecting neck, to provide a 100-cm (about 40-inch) diagonal 16:9 aspect ratio tube 10. Thus, a tube 10 would have a total depth of about 26–34 cm (about 12 inches) as compared to a depth of about 60–62 cm (about 24 inches) for a conventional 110° picture tube. It is noted that by shaping tube envelope 40, i.e. the glass funnel of tube 10, to more closely follow the trajectories of the furthest deflected electron beams 30, 30', 30", the effectiveness of the magnetostatic forces produced by electromagnets 144, 146, 148 will be improved, leading to a further reduction of the depth of tube 10. In addition, the gradual change of the magnetic field over distance as the electrons of electron beam 30 travel towards faceplate 20, i.e. the gradient field, enables a larger diameter electron beam 30 where electron beam 30 exits gun 12, thereby reducing space charge dispersion within electron beam 30 to provide a desirably smaller beam spot size at faceplate 20.

Where plural electrodes are employed in a tube 10, 110, 110', 110", the structure of the electrodes 44, 46, 48, if utilized, can include plural electrodes 44*a*, . . . , 46*a*, . . . , 48*a*, . . . which may be of several alternative forms. For example, such electrodes may be shaped strips of metal or other conductive material printed or otherwise deposited in a pattern on the inner surface of the glass tube envelope 40 of tube 10, 110, 110', 110" and connected to a source of bias potential by conductive feedthrough connections penetrating the glass wall of tube envelope 40. The shaped conductive strips can be deposited with a series of metal sublimation filaments and a deposition mask that is molded to fit snugly against the glass wall or backplate 40. If a large number of strips 44*a*, . . . , 46*a*, . . . , 48*a*, . . . are employed, each of the strips 44*a*, . . . , 46*a*, . . . , 48*a*, . . . need only be a few millimeters wide and a few microns thick, being separated by a small gap, e.g., a gap of 1–2 mm, so as to minimize charge buildup on the glass of backplate 40. A smaller number of wider strips of similar thickness and gap spacing could also be employed. Deposited metal strips 44*a*, . . . , 46*a*, . . . , 48*a*, . . . are on the surface of glass tube envelope 40 thereby maximizing the interior volume thereof through which electron beam 30 may be directed. Alternatively, such conductive strips may be metal strips spaced away a small distance from tube envelope 40 and attached thereto by a support.

Although bias potential could be applied to each of strips 44*a*, . . . , 46*a*, . . . , 48*a*, . . . by a separate conductive feedthrough, having too large a number of feedthroughs could weaken the glass structure of tube envelope 40. Thus, it is preferred that a vacuum-compatible resistive voltage divider be employed within the vacuum cavity formed by envelope 40 and faceplate 20, and located in a position shielded from electron gun 12. Such tapped voltage divider is utilized to divide a relatively very high bias potential to provide specific bias potentials for specific metal strips 44*a*, . . . , 46*a*, . . . , 48*a*, . . . .

One form of suitable resistive voltage divider may be provided by high-resistivity material on the interior surface of glass tube envelope 40, such as by spraying or otherwise applying such coating material thereto. Suitable coating materials include, for example, ruthenium oxide, and preferably exhibit a resistance in the range of $10^8$ to $10^{10}$ ohms. The high-resistivity coating is in electrical contact with the metal electrodes 44, 46, 48 for applying bias potential thereto. The thickness and/or resistivity of such coating need not be uniform, but may be varied to obtain the desired bias potential profile. Beneficially, so varying such resistive coating may be utilized for controllably shaping the profile of the bias potential over the interior surface of tube envelope 40. Thus, the complexity of the structure of electrodes 44, 46, and/or 48 may be simplified and the number of conductive feedthroughs penetrating tube envelope 40 may be reduced. In addition, such high-resistivity coating may be applied in the gaps between electrodes, such as electrodes 44, 46, 48 to prevent the build up of charge due to electrons impinging thereat.

Figure 7A:
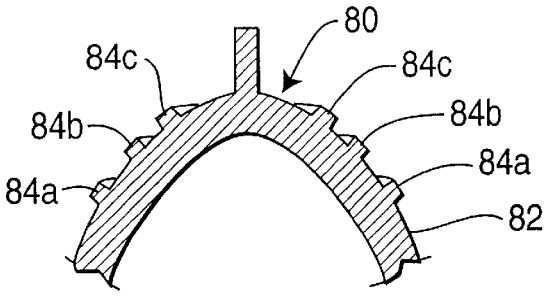
FIGS. 7A–7D are cross-sectional diagrams showing a method of forming an electrode structure in a cathode ray tube according to the invention.
Figure 7B:
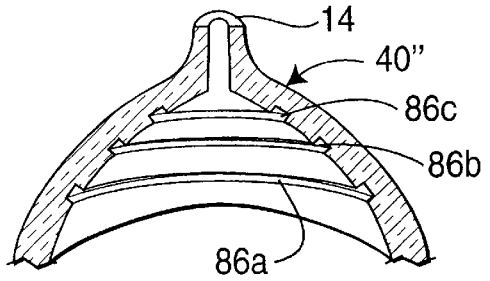
Figure 7C:
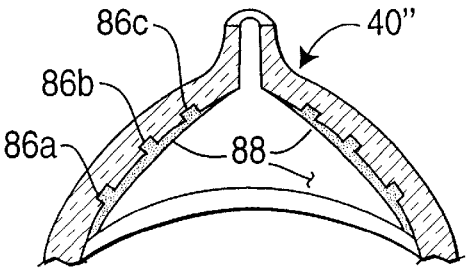
Figure 7D:
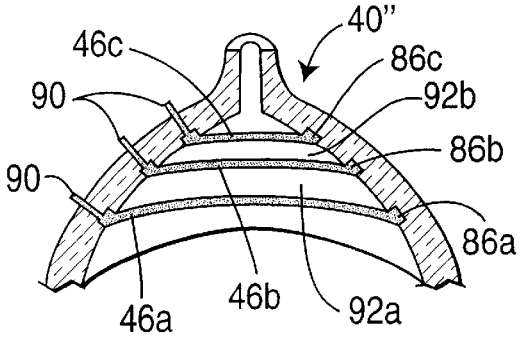

Alternatively to the masked deposition of metal strips as described above, e.g., metal strips 46*a*, 46*b*, . . . , the process illustrated in simplified and representative form in FIGS. 7A–7D can be utilized. A mold 80 has an outer surface 82 that defines the shape of the inner surface of the shaped glass bulb 40" of a cathode ray tube 10, 110 and has raised patterns 84*a*, 84*b*, 84*c* thereon defining the reverse of the size and shape of the metal strips 46*a*, 46*b*, 46*c*, as shown in FIG. 7A. Upon removal from mold 80, glass bulb 40" has a pattern of grooves 86*a*, 86*b*, 86*c* in the inner surface thereof of the size and shape of the desired metal stripes 46*a*, 46*b*, 46*c*, as shown in FIG. 7B. Next, metal such as aluminum is deposited on the inner surface of glass bulb 40" sufficient to fill grooves 86*a*, 86*b*, 86*c*, as shown in FIG. 7C. Then, the metal 88 is removed, such as by polishing or other abrasive or removal method, to leave metal strips 46*a*, 46*b*, 46*c* in grooves 86*a*, 86*b*, 86*c*, respectively, of glass bulb 40", as shown in FIG. 7D. Conductive feedthroughs 90 provide external connection to metal strip electrodes 46*a*, 46*b*, 46*c* through glass bulb 40". Optionally, high resistivity material may be applied as a coating in the gaps 92*a*, 92*b*, between electrodes 46*a*, 46*b*, 46*c*. Such materials may include, for example, graphite or carbon-based materials, aluminum oxide, and other suitable resistive materials, applied by spraying, sputtering, sublimation, spin coating or other suitable deposition method.

Thus, the cathode ray tube optionally employing electrodes positioned on the back wall and side walls thereof and biased with gradient or graduated potentials provide an electrostatic field that cooperates with the magnetic field produced by one or more electromagnets to bend the beam (s) of electrons produced by electron gun 12 (3 beams in a color tube) towards faceplate 20 and screen electrode 22 to impinge thereon, with the beam deflection provided by yoke 16 scanning the electron beam(s) over substantially the entire area of faceplate 20.

Where these optional electrodes are utilized they may be distinct plural electrode structures, such as a stack of stamped metal electrodes biased at potentials developed by a voltage divider such as that described below, or may be areas of resistive material, such as a substantially uniform resistive coating, deposited on the interior surface of the tube envelope, to develop the desired linear or other gradient potential distribution. Where the cathode ray tube has a shaped or arcuate tube envelope wherein the distinction between side wall and back wall is less clear, the equivalent of the foregoing gradient potential electrode biasing arrangement is provided by the shape and positioning of plural electrodes on or proximate to the shaped arcuate walls of the tube envelope, whether those electrodes be shaped metal electrodes or deposited resistive coatings, to provide the desired electric fields.

Figure 8:
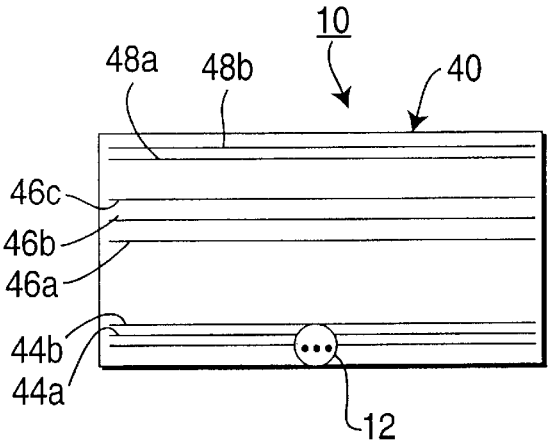
FIGS. 8 and 9 are front view schematic diagrams of an exemplary tube with the faceplate removed to show the internal arrangement of certain electrodes therein, in accordance with the invention.
Figure 9:
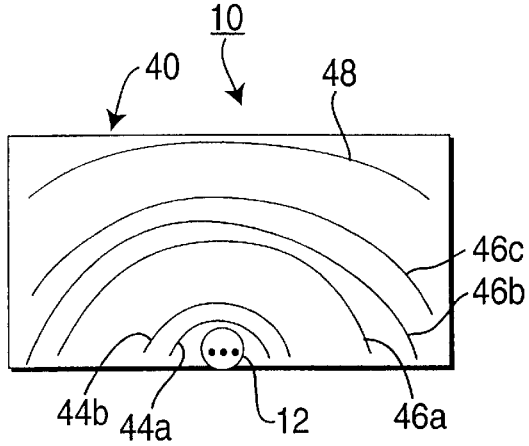

FIGS. 8 and 9 are front view diagrams of an exemplary tube with the faceplate 20 removed to show the internal arrangement thereof, in accordance with the invention. Gradient electric fields are produced within the envelope 40 of tube 10 by graduated or gradient bias potentials applied to a plurality of optional electrodes 44*a*, 44*b*, . . . 46*a*, 46*b*, . . . 48*a*, 48*b*, . . . distributed interior to tube envelope 40, such as by separate conductive metal strips, or by conductive coatings and/or resistive coatings sprayed or deposited on the inner surface of tube envelope 40. The conductive strip electrodes can be of any geometry as may be convenient or advantageous regarding the desired electron beam trajectories, and allow a more precisely shaped profile of bias potential, and the electric field produced thereby, across the volume of tube 10. Such geometry could be shaped in three dimensions and positioned to provide both the necessary electric field gradient for acceptable electron trajectory, for acceptable spot size, as well as acceptable beam convergence and/or easing the achievement of a linear raster scan, or for linearizing the drive current applied to deflection yoke 16 (not visible).

For example, narrow conductive strips, e.g., about 2.5 cm (about 1 inch) wide, can be substantially straight and parallel as illustrated in FIG. 8 or may be curved or arcuate in substantially concentric bands about the electron injection from electron gun 12 as illustrated in FIG. 9. Such plural electrodes are sometimes referred to as "sub-electrodes" making up a more generalized electrode, such as sub-electrodes 46*a*, 46*b*, . . . making up an electrode 46, and so forth. The shaping of the conductive electrodes may be employed alone or in conjunction with various methods for removing non-linearity in the raster scan produced in a tube 10. While a conventional raster scan in a conventional CRT tends to produce substantially linear horizontal lines scanned independently of a substantially linear vertical scan, application of the conventional raster scan drive signals directly to a tube 10 would produce scan lines that are substantially evenly-spaced vertically, but are curved horizontally, each being at a different substantially fixed distance from electron gun 12 (not unlike the shape of electrodes 44, 46 of FIG. 9). This effect can be compensated in several ways, including, in order of preference, generating a compensatingly non-linear horizontal scanning drive signal, or processing or morphing the image to be displayed to conform the lines thereof to the shape of the scan lines of tube 10 (i.e. perform a scan conversion which is provided by image processing circuitry), or selecting the shape of the electrodes and the bias potential gradients thereon to compensate for the non-linearity.

Figure 10A:
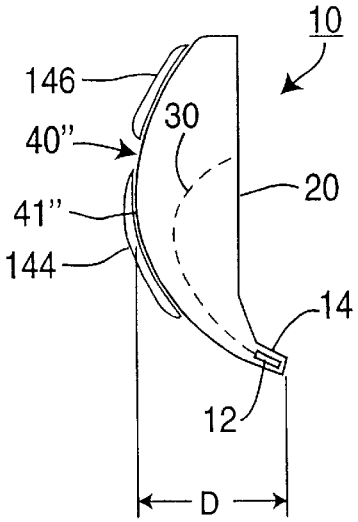
FIGS. 10A and 10B are side view cross-sectional schematic diagrams of alternative exemplary tube enclosures providing appropriately positioned electron guns within a cathode ray tube in accordance with the invention.
Figure 10B:
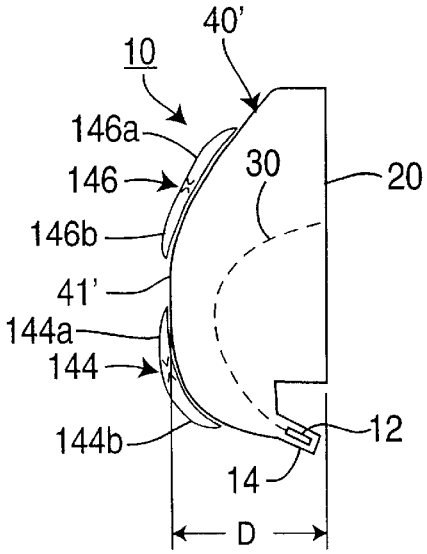

FIGS. 10A and 10B are side view cross-sectional diagrams of alternative exemplary tube enclosures 40', 40" providing appropriately positioned electron guns within a cathode ray tube 10 in accordance with the invention. In FIG. 10A, neck 14 and electron gun 12 therein are positioned entirely forward of faceplate 20, i.e. entirely on the viewer side thereof, so as to project toward the viewer. The electron injection point of electron gun 12 is approximately in the plane of faceplate 20. In this position, which is one extreme of the range of possible positions for neck 14, the depth D of tube 10 includes the spacing between faceplate 20 and rear wall 41 of tube envelope 40" plus the full horizontal extension of neck 14, which horizontal extension is offset to some degree by the resulting lesser distance between faceplate 20 and the rear wall 41". This arrangement requires less glass for tube enclosure than does the arrangement of FIG. 10B, and so is lighter and less expensive.

In FIG. 10B, neck 14 and electron gun 12 therein are positioned entirely rearward of faceplate 20 so as not to extend forward of faceplate 20 toward the viewer, and the rear of electron gun 12 is approximately in the plane of faceplate 20. In this position, which is the other extreme of the range of possible positions for neck 14, the depth D of tube 10 is the distance between faceplate 20 and the rear wall 41' of tube envelope 40', which distance is somewhat greater than that of FIG. 10A because the horizontal extension of neck 14 is within tube envelope 40'.

It is noted that the angle at which electron gun 12 is mounted may also be varied so that, in conjunction with the positioning and shape of neck 14, a desired tube 10 shape and size may be obtained. Thus, gun 12 may be angled at, for example, 35° or 45° or 60° or even 75° away from faceplate 20.

It is also noted that the tube depth D of each of the tubes 10 of FIGS. 10A and 10B are approximately the same, neither having a necessary substantial advantage over the other in regards to depth D. In both, the heat generated in tube 10 is near the front thereof, and so either may conveniently be placed in a bookcase or against a wall or other surface. Because about one-half the weight of tube 10 is in the thicker glass of faceplate 20, a support base (or feet) is required to extend both forward (toward the viewer) and rearward of faceplate 20 for safety, so as to minimize the possibility of tube 10 tipping over, especially in the direction toward the viewer. Such support base could enclose the forward projecting neck 14 of the arrangement of FIG. 10B and so the projecting neck 14 does not increase the depth of tube 10 including the support base. Thus, the arrangement of FIG. 10A is not only lighter, but also will be of lesser depth when the support base is considered.

Electromagnets 144, 146 are located on or near the shaped exterior surface of tube envelope 40', 40" and are preferably shaped to generally conformed to the shape of such surface. Alternatively, either or each of electromagnets 144 and 146 may comprise a plurality of complementary electromagnets 144*a*, 144*b* and 146*a*, 146*b*, as illustrated in FIG. 10B, for example, each preferably shaped to conform to tube envelope 40', 40", as the case may be.

Figure 11A:
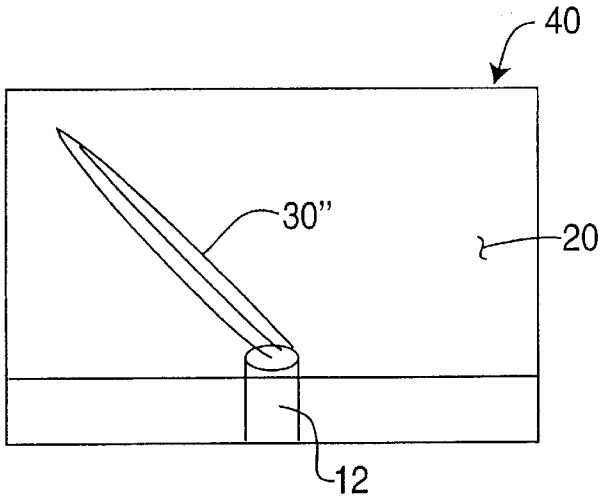
FIGS. 11A and 11B are a front view cross-sectional and side view cross-sectional schematic diagram, respectively, of a tube including a bent electron gun useful in a tube according to the invention.
Figure 11B:
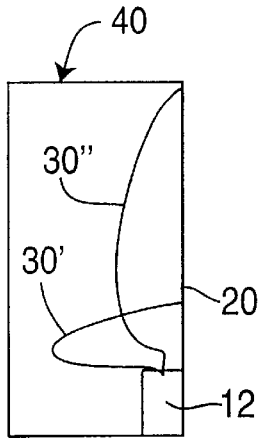

FIGS. 11A and 11B are a front view cross-sectional and side view cross-sectional schematic diagram, respectively, of a tube 10 including a vertical "bent" electron gun 12 useful in a tube 10 according to the invention. Actually, if electron gun 12 is to produce an undeflected beam of electrons 30 at an angle of about 22.5° from vertical, bent electron gun 12 includes electron optics that bend the beam or beams of electrons emerging therefrom by an angle of about 67.5°. Thus, electron gun 12 is positioned vertically, i.e. generally parallel or at a small acute angle, rather than at an about 65–70° angle, with respect to faceplate 20, and in the 6 o'clock–12 o'clock direction. The 67.5° bend provided by electron gun 12 launches the electrons of electron beam 30, 30', 30" (i.e. three beams in a color tube) in the proper direction for operation of tube 10, i.e. in a direction towards envelope 40 and away from faceplate 20. This arrangement eliminates the neck 14 projecting out of tube envelope 40.

Figure 12A:
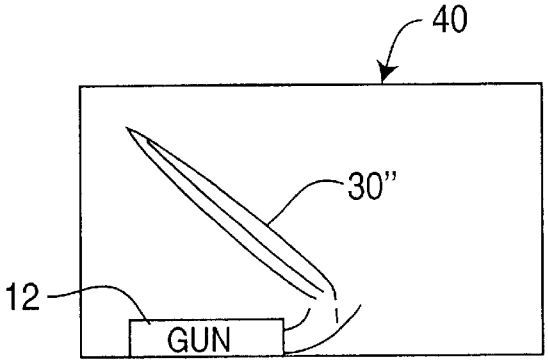
FIGS. 12A and 12B are a front view cross-sectional and side view cross-sectional schematic diagram, respectively, of a tube including a bent electron gun useful in a tube according to the invention.
Figure 12B:
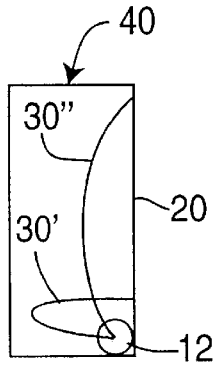

FIGS. 12A and 12B are a front view cross-sectional and side view cross-sectional schematic diagram, respectively, of a tube 10 including a horizontal 90° bent electron gun 12 useful in a tube 10 according to the invention. Thus, electron gun 12 is positioned horizontally, i.e. generally parallel to and against the bottom edge of faceplate 20, and in the 3 o'clock–9 o'clock direction. The 90° bend provided by electron gun 12 launches the electrons of electron beam 30, 30', 30" (i.e. three beams in a color tube) in the proper direction for operation of tube 10, i.e. in a direction towards envelope 40 and away from faceplate 20. This arrangement eliminates the neck 14 projecting out of tube envelope 40, and does not require additional vertical space as does the vertical electron gun arrangement of FIG. 11A. Gun 12 of FIGS. 11A, 11B, 12A and 12B includes internal to tube envelope 40 means to bend the electron beam(s) 30, 30', 30" and also means to deflect the beam(s) 30. 30', 30" for raster scan on faceplate 20.

Figure 13A:
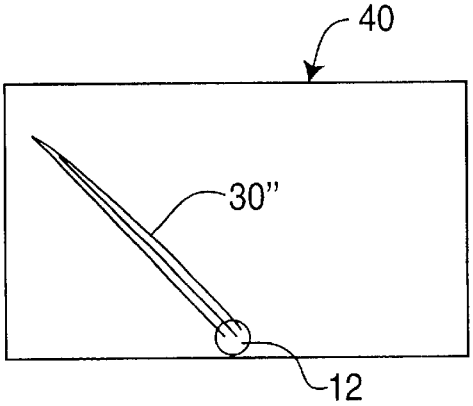
FIG. 13A is a front view cross-sectional and FIG. 13B is a side view cross-sectional schematic diagram, respectively, of a tube including a bent electron gun useful in a tube according to the invention.
Figure 13B:
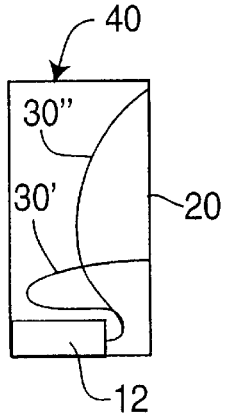

FIGS. 13A and 13B are a front view cross-sectional and side view cross-sectional schematic diagram, respectively, of a tube 10 including a bent electron gun 12 useful in a tube according to the invention. Bent electron gun 12 includes electron optics that bend the beam or beams of electrons emerging therefrom by an angle of about 157.5°, more or less. Thus, electron gun 12 is positioned horizontally, i.e. generally perpendicular to and pointing toward faceplate 20. The 157.5° bend provided by electron gun 12 launches electron beam 30, 30', 30" (i.e. three beams in a color tube) in the proper direction for operation of tube 10, i.e. in a direction towards envelope 40 and away from faceplate 20. This arrangement does not require a projecting neck 14 or additional vertical space as does the vertical electron gun arrangement of FIG. 11A, however, gun 12 includes internal to tube envelope 40 means to bend the electron beam(s) 30, 30', 30" and means to deflect the beam(s) 30, 30', 30" for raster scan on faceplate 20.

Figure 14:
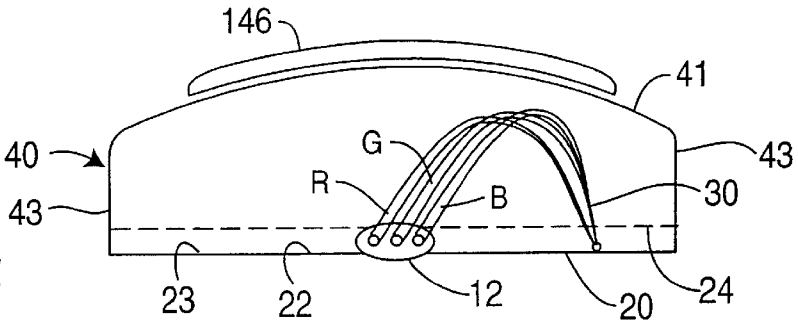
FIG. 14 is a top view cross-sectional schematic diagram of an exemplary tube, for example, the tube of FIGS. 2, 3, 4, 5, 6, 10A and 10B, illustrating a shaped rear wall structure for appropriately positioning electromagnets on a cathode ray tube in accordance with the invention.

FIG. 14 is a top view cross-sectional schematic diagram of an exemplary tube, for example, the tube 10 of FIGS. 2, 3, 4, 5, 6, 10A and/or 10B, illustrating an exemplary shaped electromagnet 146 positioned on or near the exterior surface of a cathode ray tube 10 in accordance with the invention. Electron gun 12 includes three electron sources in, for example, a horizontal in-line arrangement, producing three beams of electrons 30 that are deflected by the electric fields produced at least by electromagnet 146, illustrated. The three electron beams 30 are slightly separated at electron gun 12 and are converged through respective apertures in shadow mask 24 onto essentially a common spot on faceplate 20, which common spot includes three light-emitting phosphors that emit different color light to produce a color image in response to the three electron beams 30. Such convergence requires a field that gradually moves (or converges) the outer two beams (e.g., the red R and blue B beams) towards the center beam (e.g., the green G beam) and that is provided by the shaping of electromagnet 144 and/or 146 and/or 48 (only electromagnet 146 is visible) located on or near rear wall 41 of tube envelope 40 and by appropriately selecting the bias current(s) applied thereto. Electromagnet 146 may be shaped as an arcuate section of a relatively large radius cylinder having a central axis in the 6 o'clock–12 o'clock direction forward of faceplate 20. The field that converges the R, G, B beams also provides focusing of each of such beams in the horizontal direction. As described above in relation to FIGS. 1 and 4, for example, rear wall 43 of tube envelope 40 may have the desired arcuate or curved shape and shaped electromagnets 144, 146, and/or 148 may be glued, bonded or otherwise mounted thereon or attached thereto.

Figure 15B:
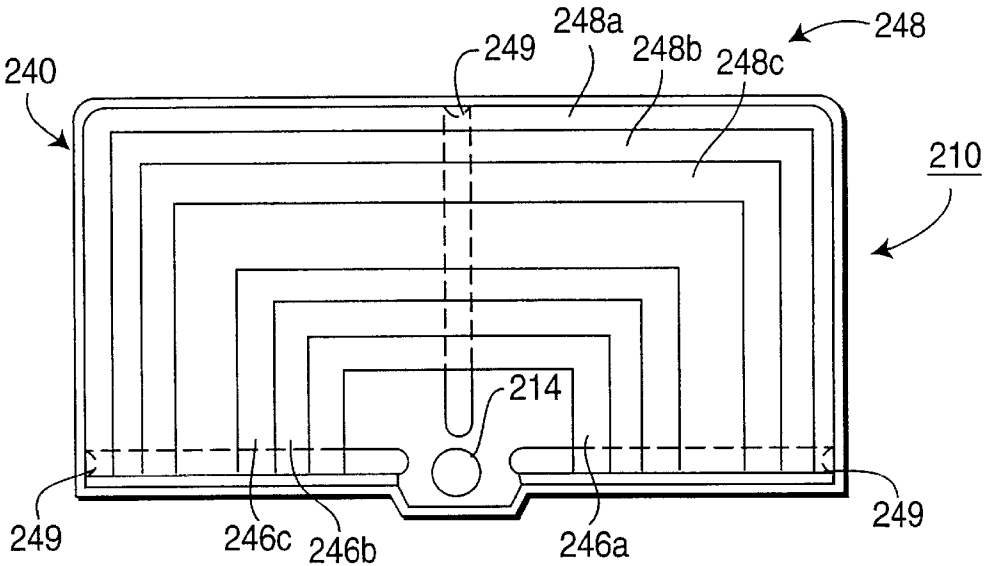
FIGS. 15A and 15B are a side view cross-sectional schematic diagram and a front view schematic diagram of a further alternative exemplary tube showing a structure providing appropriately positioned alternative electrodes within a cathode ray tube in accordance with the invention.
Figure 15A:
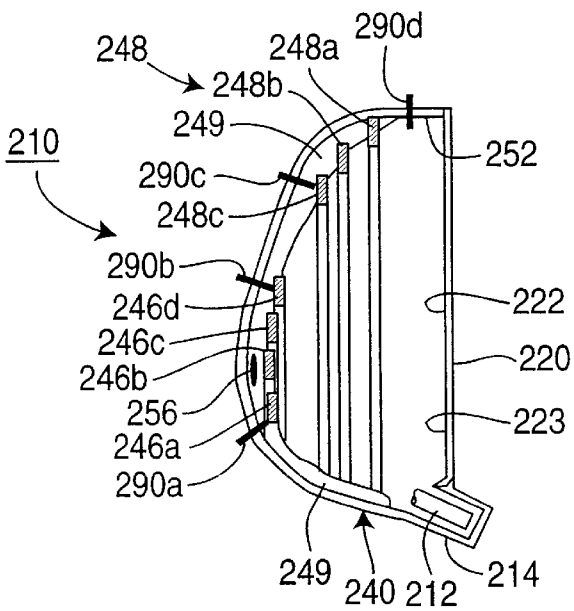

FIGS. 15A and 15B are a side view cross-sectional diagram and a front view diagram of an alternative exemplary cathode ray tube 210 (with faceplate 220 removed) illustrating an alternative exemplary structure providing appropriately positioned electrodes 244, 246, 248 within cathode ray tube 210, one or more of which may be utilized with an electromagnet positioned on tube envelope 240 in accordance with the invention. Each of the electrodes 246, 248 has a generally "C" or "U" like shape (e.g., such as a partial rectangular ring-like shape) of respectively larger dimension to form an array of spaced apart ring electrodes 246, 248 symmetrically disposed within the interior of funnel-shaped glass bulb 240 of cathode ray tube 210. The electrodes 246, 248 are preferably stamped metal, such as titanium, steel, aluminum or other suitable metal, and are mounted within glass bulb 240 by a plurality of mounts, such as elongated glass beads 249, although clips, brackets and other mounting arrangements may be employed.

Assembly is quick and economical where the C-shaped metal electrodes 246, 248 are formed of respective plural sub-electrodes 246*a*, 246*b*, . . . , 248*a*, 248*b*, . . . and are substantially simultaneously secured in their respective relative positions in the three glass beads 249 with the glass beads 249 positioned, for example, at three locations such as the 12 o'clock, 3 o'clock, and 9 o'clock (i.e. 0°, 90°, and 270°) positions as shown, thereby to form a rigid, self-supporting structure. The assembled electrode structure is then inserted, properly positioned and secured within glass bulb 240, and faceplate 220 is then attached and sealed.

Appropriate electrical connections of predetermined ones of electrodes 246, 248 are made to bias potential feedthroughs 290 penetrating the wall of glass bulb 240. Electrical connections between ones of feedthroughs 290 (e.g., designated 290*a*, 290*b*, . . . ) and predetermined ones of rectangular electrodes 246, 248 are made by wires, by welding or by snubbers on the electrodes that touch or contact the feedthrough 290 conductors. Feedthroughs 290 need be provided only for the highest and lowest bias potentials because intermediate potentials may be obtained by resistive voltage dividers connected to the feedthroughs 290 and appropriate ones of rectangular electrodes 246, 248. High positive potential from feedthrough 290*d* is conducted to screen electrode 222 by deposited conductor 252 and to gun 212.

Rectangular electrodes 246, 248 can be made of a suitable metal to provide magnetic shielding, such as steel, mu metal or nickel alloy, or one or more magnetic shields could be mounted external to glass bulb 240. Electron gun 212, faceplate 220, screen electrode 224 and phosphors 223 are substantially like the corresponding elements described above. A plural electrode 244 corresponding to optional electrode 44 above could be of similar construction.

In addition, evaporable getter material 256, such as a barium getter material, may be mounted to the back surface of electrodes 246 and/or 248 and/or the inner surface of glass bulb 240, or in the space therebetween, from where it is evaporated onto the back surfaces of electrodes 248 and/or 246 and/or the inner surface of glass bulb 240. Getter material 256 is positioned so as to not coat any important insulating elements, e.g., glass beads supporting electrodes 246, 248.

Figure 16:
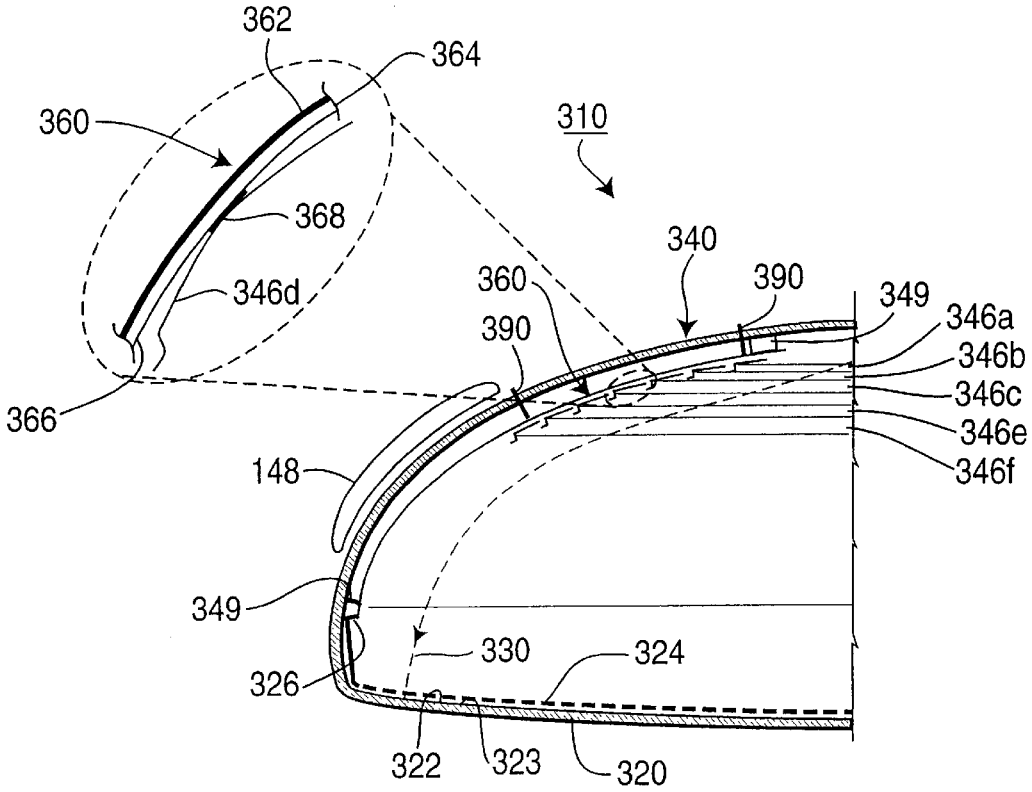
FIG. 16 is a partial side view cross-sectional schematic diagram of a portion of a cathode ray tube according to the invention showing an exemplary alternative electrode structure therefor.

FIG. 16 is a partial cross-sectional diagram of a portion of asymmetric cathode ray tube 310 distal the neck 314 thereof (not shown, which is in centered position near the 6 o'clock edge of tube 310, i.e. off to the right of the portion shown in FIG. 16) showing an alternative mounting arrangement for a set of electrodes 346 mounted within the interior of shaped glass bulb 340 to deflect electron beam 330 as described above. Electron gun 312, neck 314, faceplate 320, phosphors 323, shadow mask 324 and frame 326, glass bulb 340 are disposed substantially as described above, and tube 310 may include a getter material as above in the space between glass bulb 340 and electrodes 346.

Electrodes 346 are formed as a set of generally "C" or "U" shaped metal sub-electrodes 346*a*, 346*b*, . . . , 346*f*, for example, of ascending dimension and are positioned symmetrically with respect to a tube central axis in the 6 o'clock–12 o'clock direction with the smallest electrode proximate neck 314 and the largest proximate faceplate 320. Plural support structures 360 are employed to support electrodes 346, such as three supports 360 disposed 90° apart extending in the 9 o'clock, 12 o'clock and 3 o'clock positions, only one of which is visible in FIG. 16. Each support structure 360 is generally shaped to follow the shape of glass bulb 340 and is mounted between and attached to two or more insulating supports 349, such as glass beads or lips, one proximate shadow mask frame 326 and the other(s) spaced along the wall of glass bulb 340. Each of sub-electrodes 346*a*, 346*b*, . . . is electrically isolated from the other ones thereof, unless it is desired that two or more of electrodes 346*a*, 346*b*, . . . be at the same bias potential. Electrodes 346*a*, 346*b* are preferably of stamped metal, such as titanium, steel, aluminum, mu- metal or nickel alloy and are preferably of a magnetic shielding metal such as mu metal or nickel alloy to shield electron beam(s) 330 from unwanted deflection caused by the earth's magnetic field and other unwanted fields.

Each support strip 360 is formed of a layered structure of a metal base 362, such as a titanium strip, for strength, a ceramic or other insulating material layer 364 on at least one side of the metal base 362, and spaced weldable contact pads 368 including a weldable metal, such as nickel or nichrome, to which the electrodes 346*a*, 346*b*, . . . , 346*f* are welded, as shown in the expanded inset of FIG. 16. Weldable pads 368 are electrically isolated from each other and from metal base 362 by ceramic layer 364, so that different bias potentials may be established on each of electrodes 346*a*, 346*b*, . . . .

Figure 17:
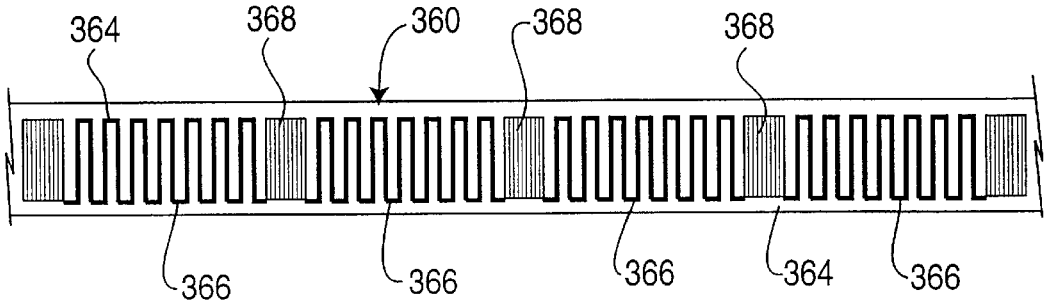
FIG. 17 is a front view of a portion of the exemplary electrode structure of FIG. 16.

Preferably, one or more of support strips 360 includes a high-resistivity electrical conductor 366, such as ruthenium oxide, preferably formed in a serpentine pattern on ceramic layer 364 to provide resistors having a high resistance, e.g., on the order of $10^9$ ohms, that together form a resistive voltage divider that apportions the bias potentials applied at the various feedthroughs 390 to develop the desired bias potential for each one of electrodes 346*a*–346*f*. A ceramic layer 364 may be placed on one or both sides of metal base strip 362, and a resistive layer 366 may be formed on either or both of ceramic layers 364. A portion of one side of an exemplary support structure having serpentine high-resistance resistors 366 between weldable contact pads 368 on ceramic insulating layer 364 is illustrated in FIG. 17. Electrical connections may be made from selected appropriate ones of contact pads 368 to various points within tube 310 at which suitable bias potentials are present, such as to gun 312 and to screen electrode 322 for applying respective appropriate bias potentials thereto. Support strips 360 are preferably formed of fired laminates of the metal base and ceramic insulating and ceramic circuit layers, such as the low-temperature co-fired ceramic on metal (LTCC-M) process described in U.S. Pat. No. 5,581,876 entitled "Method of Adhering Green Tape To A Metal Substrate With A Bonding Glass."

Stamped metal electrodes 346*a*–346*f* and support strips 360 are assembled together into an assembly having sufficient strength to maintain its shape (owing to the strength of each component thereof) and the assembled electrodes are inserted into the interior of glass bulb 340 to the desired position, and are held in place by clips or welds (not visible) near the shadow mask frame 326 and support 349 near neck 314. The assembled structure of electrodes 346 and support strips 360 preferably conforms approximately to the interior shape of glass bulb 340 and is slightly spaced away therefrom. However, the structure of electrodes 346 and support strips 360 is positioned outside the volume through which electron beam 330 passes at any position in its scan including the extremes of deflection produced by the magnetic deflection yoke (not shown) and the bias potentials applied to electrodes 346. Electrodes 346*a*–346*f* are preferably shaped so as to shield objects behind them, such as support strips 360 and uncoated areas of the inner surface of glass bulb 340, and getter materials, if any, from impingement of electrons from electron beam 330.

Figure 18:
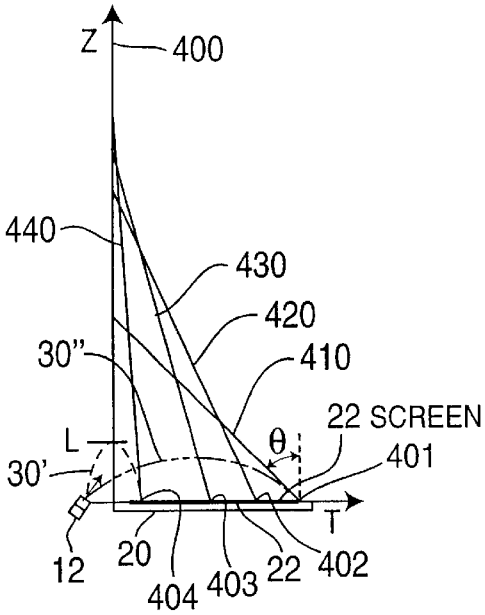
FIGS. 18 and 19 are graphical representations useful in understanding a method for forming a color phosphor pattern on the screen of a tube according to the invention.
Figure 19:
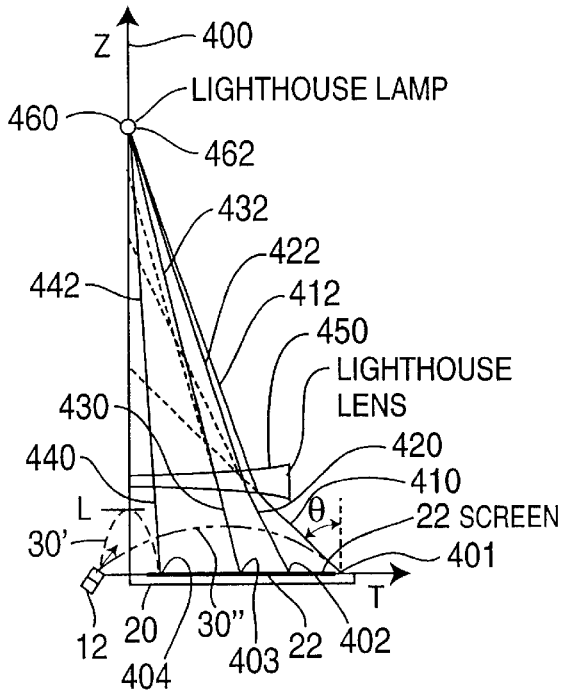

FIGS. 18 and 19 are graphical representations useful in understanding a method of forming a color phosphor pattern 23 on the screen 22 of tube 10. Horizontal axis T represents the distance between electron gun 12 and the point at which the deflected beam 30', 30" lands on the screen electrode 22 which is already deposited on faceplate 20, i.e. the throw distance of electron beam 30. Vertical axis Z represents distance perpendicularly behind screen electrode 22. For a color tube, a pattern of red, green and blue phosphors is formed on screen electrode 22, such as a pattern of alternating red, green and blue phosphor stripes that are vertical when faceplate 20 is in the normal viewing position, e.g., with electron gun 12 at the 6 o'clock position. These stripes must be in registration with a shadow mask positioned relatively close thereto(e.g., about 1–2 cm) which masks the three individual electron beams of electron beam 30 so that each impinges upon the appropriate one of the red, green and blue phosphor stripes, respectively.

The angle Θ represents the off-perpendicular angle at which electron beam 30 lands on screen electrode 22. For example, with electron beam 30 exiting electron gun 12 at the plane of screen electrode 22, the throw distance T and height L of the trajectory of electron beam 30 is given by: $T=4L(\sin\Theta)(\cos\Theta)$ which reduces to: $T=2L\sin 2\Theta$, and the angle Θ is given by: $\Theta=0.5\sin^{-1}(T/2L)$. Electron beam 30 is illustrated by beam 30" in a long throw deflection landing at position 401 and by beam 30' in a short throw deflection landing at position 404. Intermediate, landing positions 402, 403 are also illustrated. Lines 410, 420, 430, 440 are the extensions of the angle Θ) at landing positions 401, 402, 403, 404, respectively, and intersect Z-axis 400 at different distances Z from screen 22. The distance Z is given by: $Z=(\text{cotan}\,\Theta)(4L\cos\Theta\sin\Theta)$ which reduces to: $Z=4L\cos^2\Theta$. For a 16:9 aspect ratio tube having a diagonal of about 96.5 cm (about 38 inches), the approximate characteristics are as follows:

| T (cm) | Θ | Z (cm) |
|---|---|---|
| 10 cm | 5° | 120 cm |
| 30 cm | 15° | 112 cm |
| 45 cm | 24° | 100 cm |
| 60 cm | 45° | 60 cm |

Because lines 410, 420, 430, 440 intersect Z axis 400 at different points, there is no point at which a light source can be placed to simultaneously expose a photo resist material to define the stripes or other pattern of phosphors.

To properly expose such photoresist, an optical lens 450 is spaced apart from screen 22 to refract ray lines 410, 420, 430, 440 to intersect Z axis 400 at a common point 460 at which a light source 462 can be placed. Lens 450 is a "lighthouse lens" having opposing concave surfaces so as to "bend" ray lines 410, 420, 430, 440 by a progressively smaller angle with decreasing distance of the respective landing point 401, 402, 403, 404 from Z axis 400. Thus, ray line 440 is only slightly bent to follow line 442 to common point 460 and line 420 is bent by a greater angle to follow line 422 to point 460. Line 410 is bent by an even greater amount to follow line 412 to point 460. Thus, lighthouse lamp 462 at common point 460 produces light rays that are bent at progressively greater angles when passing through lighthouse lens 450 at progressively greater distances from axis 400 to land on screen 22 at the proper angle to expose a photoresist material on screen 22 through a mask (not shown) spaced apart a short distance from screen 22.

While the present invention has been described in terms of the foregoing exemplary embodiments, variations within the scope and spirit of the present invention as defined by the claims following will be apparent to those skilled in the art. For example, the present cathode ray tube can be a monochrome tube having a phosphor coating on the inner surface of the faceplate thereof or may be a color tube having a pattern of color phosphors thereon and a shadow mask having a pattern of apertures corresponding to the pattern of color phosphors, whether described herein as having or not having a shadow mask. Where a higher efficiency shadow mask, focus mask, or other similar structure is available, such as a shadow mask that enables a larger proportion of the electrons of electron beam to pass through the apertures thereof, such high-efficiency shadow mask could be employed in cathode ray tubes of the present invention, thereby resulting in one or more of increased brightness, reduced spot size or reduced gun diameter (and the benefit of reduced yoke power associated therewith).

It is noted that one or more permanent magnets producing a magnetic field equivalent to that produced by any one or more electromagnets may be substituted for such one or more of the electromagnets described herein.

Figure 20A:
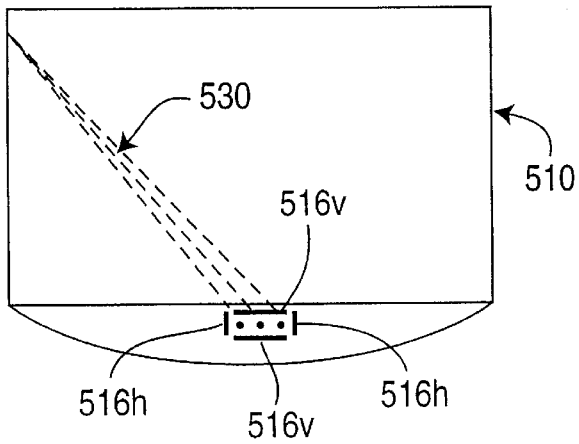
FIGS. 20A and 20B are a front view cross-sectional and side view cross-sectional schematic diagram, respectively, of a tube including an alternative scanning deflection arrangement useful in a tube according to the invention.
Figure 20B:
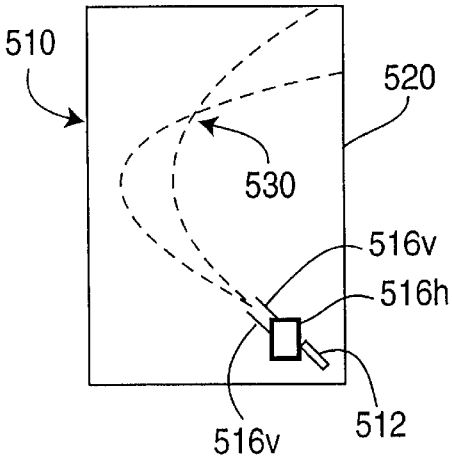

While scanning deflection of the electron beam is typically magnetic as provided by a magnetic deflection yoke, scanning deflection of the electron beam 430 as it exits the electron gun 412 can be provided by electrostatic or magnetic deflection plates, one pair 416*v* for vertical scanning deflection and one pair 416*h* for horizontal scanning deflection, as illustrated by tube 410 of FIGS. 20A and 20B. Bias potentials developed by voltage dividers may be developed by resistive voltage dividers, and other suitable voltage dividers.

What is claimed is:

1. A tube comprising:

a tube envelope having a faceplate, a backplate opposite the faceplate and a screen electrode on the faceplate adapted to be biased at a screen potential;

a source of at least one beam of electrons directed away from said faceplate in a volume between the backplate and the screen electrode, wherein said source is adapted for scanning deflection of said at least one beam of electrons;

phosphorescent material disposed on said faceplate for producing light in response to the at least one beam of electrons impinging thereon; and at least a first magnetic source disposed proximate the backplate of said tube envelope to produce a magnetic field in the volume between the backplate and the screen electrode for tending to bend the at least one beam of electrons in a direction towards said faceplate.

2. The tube of claim 1 wherein said first magnetic source comprises at least a first electromagnet disposed proximate the backplate of said tube envelope intermediate said source of at least one beam of electrons and said faceplate, and wherein said first electromagnet is poled for tending to bend the at least one beam of electrons in a direction towards said faceplate.

3. The tube of claim 1 further comprising at least a second magnetic source disposed proximate the backplate of said tube envelope for producing a magnetic field in the volume between the backplate and the screen electrode for tending to bend the at least one beam of electrons in a direction towards said faceplate, wherein said second magnetic source is intermediate said first magnetic source and said faceplate.

4. The tube of claim 3 wherein said second magnetic source comprises at least a second electromagnet disposed proximate the backplate of said tube envelope intermediate said first magnetic source and said faceplate, and wherein said second electromagnet is poled for tending to bend the at least one beam of electrons in a direction towards said faceplate.

5. The tube of claim 3 wherein said source of at least one beam of electrons is positioned proximate an edge of said faceplate, and wherein said first and second magnetic sources are spaced apart in a substantially radial direction relative to said source.

6. The tube of claim 3 wherein at least one of said first and second magnetic sources includes a plurality of a given number of electromagnets, wherein each of the electromagnets of said plurality of electromagnets is poled in a like sense.

7. The tube of claim 6 wherein each electromagnet of said plurality of electromagnets is shaped to conform to said tube envelope.

8. The tube of claim 1 further comprising at least one electrode interior said tube envelope, said at least one electrode being positioned one of nearer and closer to said faceplate than said first magnetic source, said electrode being adapted to be biased at a potential not exceeding the screen potential for producing an electric field in a region through which the at least one beam of electrons passes.

9. The tube of claim 8 wherein said electrode includes one of a conductive material on an interior surface of said tube envelope and a metal electrode proximate the interior surface of said tube envelope.

10. The tube of claim 8 wherein said electrode includes a plurality of sub-electrodes adapted to be biased at different potentials, wherein at least one of said sub-electrodes is electrically connected to a conductor penetrating said tube envelope.

11. The tube of claim 10 further comprising a voltage divider within said tube envelope and adapted for receiving a bias potential for developing at least one of the potentials at which one of said sub-electrodes are adapted to be biased.

12. The tube of claim 1 further comprising a shadow mask proximate said faceplate having a plurality of apertures therethrough, said shadow mask adapted to be biased at the screen potential, and wherein said phosphorescent material includes a pattern of different phosphorescent materials on said faceplate that emit different color light in response to the at least one beam of electrons impinging thereon through the apertures of said shadow mask.

13. A tube comprising:

a tube envelope having a faceplate and a screen electrode on the faceplate adapted to be biased at a screen potential;

a source of at least one beam of electrons directed away from said faceplate, wherein said source is adapted for scanning deflection of said at least one beam of electrons;

phosphorescent material disposed on said faceplate for producing light in response to the at least one beam of electrons impinging thereon; and at least a first magnetic source disposed proximate said tube envelope to produce a magnetic field therein for tending to bend the at least one beam of electrons in a direction towards said faceplate;

at least a second magnetic source disposed proximate said tube envelope for producing a magnetic field therein for tending to bend the at least one beam of electrons in a direction towards said faceplate, wherein said second magnetic source is intermediate said first magnetic source and said faceplate; and at least a third magnetic source disposed proximate said tube envelope for producing a magnetic field therein for tending to bend the at least one beam of electrons in a direction toward said faceplate, wherein said third magnetic source is intermediate said second magnetic source and said faceplate.

14. The tube of claim 13 wherein said third magnetic source comprises at least a third electromagnet disposed proximate said tube envelope intermediate said second magnetic source and said faceplate, wherein said third electromagnet is poled for tending to bend the at least one beam of electrons in a direction toward said faceplate.

15. The tube of claim 13 wherein said at least one of said first, second, and third magnetic sources is shaped to conform to said tube envelope.

16. A tube comprising:

a tube envelope having a faceplate, a backplate opposite the faceplate and a screen electrode on the faceplate adapted to be biased at a screen potential;

a source of at least one beam of electrons directed away from said faceplate, wherein said source is adapted for scanning deflection of said at least one beam of electrons;

phosphorescent material disposed on said faceplate for producing light in response to the at least one beam of electrons impinging thereon; and at least first and second electromagnets disposed proximate the backplate of said tube envelope intermediate said source of at least one beam of electrons and said faceplate, wherein said first and second electromagnets are poled to produce a magnetic field in a volume between the backplate and the screen electrode for tending to bend the at least one beam of electrons in a direction towards said faceplate.

17. The tube of claim 16 further comprising an electrode interior said tube envelope and positioned one of nearer to and farther from said faceplate than at least one of said first and second electromagnets, said electrode being adapted to be biased at a potential not exceeding the screen potential for producing an electric field in a region through which the at least one beam of electrons passes for tending to bend the at least one beam of electrons in a direction toward said faceplate.

18. A tube comprising:

a tube envelope having a faceplate, a backplate opposite the faceplate and a screen electrode on the faceplate adapted to be biased at a screen potential;

a source of at least one beam of electrons directed away from said faceplate, wherein said source is adapted for scanning deflection of said at least one beam of electrons;

phosphorescent material disposed on said faceplate for producing light in response to the at least one beam of electrons impinging thereon;

at least a first electromagnet disposed proximate the backplate of said tube envelope intermediate said source of at least one beam of electrons and said faceplate, and wherein said first electromagnet is poled to produce a magnetic field in a volume between the backplate and the screen electrode for tending to bend the at least one beam of electrons in a direction toward said faceplate; and at least one electrode interior said tube envelope and positioned one of nearer to and farther from said faceplate than said first electromagnet, said electrode being adapted to be biased at a potential not less than screen potential for producing an electric field in a region through which the at least one beam of electrons passes for tending to bend the at least one beam of electrons in a direction toward said faceplate.

19. A cathode ray tube comprising:

a tube envelope having a generally flat faceplate and a screen electrode on the faceplate adapted to be biased at a screen potential, having a backplate opposite the faceplate and having a tube neck adjacent said faceplate;

in said tube neck, a source of at least one beam of electrons directed away from said faceplate, wherein said source is adapted for scanning deflection of said at least one beam of electrons;

a deflection yoke around said tube neck for deflecting the at least one beam of electrons from said source over a predetermined range of deflection angles;

phosphorescent material disposed on said faceplate for producing light in response to the at least one beam of electrons impinging thereon; and at least one magnetic source mounted on an exterior surface of the backplate of said tube envelope intermediate said source of at least one beam of electrons and said faceplate, wherein said magnetic source produces a magnetic field in a volume between the backplate and the screen electrode for deflecting the at least one beam of electrons in a direction towards said faceplate; and at least one static deflection element mounted on said tube envelope one of nearer to and farther from said faceplate than said magnetic source, said static deflection element being biased for deflecting said at least one beam of electrons towards said faceplate, whereby the deflected at least one beam of electrons further deflected by at least one of said magnetic source and said static deflection element impinges on an area of said faceplate.

20. The cathode ray tube of claim 19 wherein said at least one magnetic source includes one of a first electromagnet and a permanent magnet.

21. The cathode ray tube of claim 19 wherein said at least one static deflection element includes one of a second electromagnet mounted on the exterior surface of said tube envelope and an electrode mounted on an interior surface thereof.

22. The cathode ray tube of claim 19 further comprising a shadow mask proximate said faceplate having a plurality of apertures therethrough, said shadow mask adapted to be biased at said screen potential, and wherein said phosphorescent material includes a pattern of different phosphorescent materials that emit different respective colors of light in response to said at least one beam of electrons impinging thereon.

23. A display comprising:

a tube envelope having a faceplate, a backplate opposite the faceplate and a screen electrode on the faceplate biased at a screen potential;

a source within said tube envelope of at least one beam of electrons directed away from said faceplate;

a deflection yoke proximate said source of at least one beam of electrons for magnetically deflecting said at least one beam of electrons;

phosphorescent material disposed on said faceplate for producing light in response to the at least one beam of electrons impinging thereon;

at least a first electromagnet disposed proximate the backplate of said tube envelope intermediate said source of at least one beam of electrons and said faceplate, wherein said at least first electromagnet is poled to produce a magnetic field in a volume between the backplate and the screen electrode for tending to bend the at least one beam of electrons in a direction towards said faceplate; and a source of direct current bias for said at least first electromagnet and of bias potential for said screen electrode.

24. The display of claim 23 further comprising at least a second electromagnet disposed proximate said tube envelope intermediate said first electromagnet and said faceplate, wherein said second electromagnet is poled for tending to bend the at least one beam of electrons in a direction toward said faceplate.

25. The display of claim 24 wherein said source of at least one beam of electrons is positioned proximate an edge of said faceplate, and wherein said first and second electromagnets are spaced apart in a substantially radial direction relative to said source.

26. A display comprising:

a tube envelope having a faceplate and a screen electrode on the faceplate biased at a screen potential;

a source within said tube envelope of at least one beam of electrons directed away from said faceplate;

a deflection yoke proximate said source of at least one beam of electrons for magnetically deflecting said at least one beam of electrons;

phosphorescent material disposed on said faceplate for producing light in response to the at least one beam of electrons impinging thereon;

at least a first electromagnet disposed proximate said tube envelope intermediate said source of at least one beam of electrons and said faceplate, wherein said at least first electromagnet is poled for tending to bend the at least one beam of electrons in a direction towards said faceplate; and a source of direct current bias for said at least first electromagnet and of bias potential for said screen electrode;

at least a second electromagnet disposed proximate said tube envelope intermediate said first electromagnet and said faceplate, wherein said second electromagnet is poled for tending to bend the at least one beam of electrons in a direction toward said faceplate; and at least a third electromagnet disposed proximate said tube envelope intermediate said second electromagnet and said faceplate, wherein said third electromagnet is poled for tending to bend the at least one beam of electrons in a direction toward said faceplate.

27. The display of claim 26 wherein said at least one of said first, second, and third electromagnets is shaped to conform to said tube envelope.

28. The display of claim 24 wherein at least one of said first and second electromagnets includes a plurality of a given number of electromagnets, and wherein each electromagnet of said plurality of electromagnets is shaped to conform to said tube envelope.

29. The display of claim 23 further comprising at least one electrode interior to said tube envelope, said at least one electrode being positioned one of nearer and closer to said faceplate than said first electromagnet, said electrode being biased by said source at a potential not exceeding the screen potential for producing an electric field in a region through which the at least one beam of electrons passes.

30. The display of claim 29 wherein said electrode includes one of a conductive material on an interior surface of said tube envelope and a metal electrode proximate the interior surface of said tube envelope.

31. A tube comprising:

a tube envelope having a faceplate, having a back plate opposing the faceplate, and having a screen electrode on the faceplate adapted to be biased at a screen potential;

a source of plural beams of electrons directed away from said faceplate and toward said backplate, wherein said source is adapted for scanning deflection of said plural beams of electrons;

phosphorescent material disposed on said faceplate for producing light in response to the plural beams of electrons impinging thereon;

a first magnetic source disposed proximate the backplate of said tube envelope to produce a magnetic field between the faceplate and the backplate for bending the plural beams of electrons in a direction towards said faceplate; and a second magnetic source disposed proximate the backplate of said tube envelope for producing a magnetic field between the faceplate and the backplate for bending the plural beams of electrons in a direction towards said faceplate, wherein said second magnetic source is intermediate said first magnetic source and said source.

32. A tube comprising:

a faceplate having a near edge and a far edge, a screen electrode on said faceplate adapted to be biased at a screen potential;

phosphorescent material disposed on said faceplate for producing light in response to electrons impinging thereon;

a tube envelope joined to said faceplate at least at the near and the far edges thereof, wherein the joined tube envelope and faceplate define a tube volume therebetween;

a source of at least one beam of electrons disposed proximate the near edge of said faceplate, wherein the at least one beam of electrons is directed into the tube volume in a direction away from said faceplate;

means for scanning deflection of the at least one beam of electrons within the tube volume;

a first magnetic source disposed proximate said tube envelope and relatively distal the near edge of said faceplate for providing a magnetic field within the tube volume between the near and far edges of said faceplate for bending the at least one beam of electrons within the tube volume in a direction towards said faceplate; and a second magnetic source disposed proximate said tube envelope and relatively proximal the near edge of said faceplate for providing a magnetic field within the tube volume between the near and far edges of said faceplate for bending the at least one beam of electrons within the tube volume in a direction towards said faceplate, whereby the scanningly deflected beam of electrons are deflected by the first and second magnetic sources to be directed towards the faceplate to impinge upon the phosphorescent material thereon.

* * * * *